US009391374B2

(12) United States Patent
Roy

(10) Patent No.: US 9,391,374 B2
(45) Date of Patent: Jul. 12, 2016

(54) RECIPROCAL CIRCULAR POLARIZATION SELECTIVE SURFACES AND ELEMENTS THEREOF

(71) Applicant: Jasmin Roy, Gatineau (CA)

(72) Inventor: Jasmin Roy, Gatineau (CA)

( * ) Notice: Subject to any disclaimer, the term of this patent is extended or adjusted under 35 U.S.C. 154(b) by 360 days.

(21) Appl. No.: 13/936,490

(22) Filed: Jul. 8, 2013

(65) Prior Publication Data

US 2014/0009365 A1 Jan. 9, 2014

Related U.S. Application Data

(60) Provisional application No. 61/669,978, filed on Jul. 10, 2012, provisional application No. 61/669,409, filed on Jul. 9, 2012.

(51) Int. Cl.
*H01Q 15/02* (2006.01)
*H01Q 15/24* (2006.01)

(52) U.S. Cl.
CPC ..... *H01Q 15/24* (2013.01)

(58) Field of Classification Search
USPC ..... 343/702, 909, 700 MS
See application file for complete search history.

(56) References Cited

U.S. PATENT DOCUMENTS

| | | | | |
|---|---|---|---|---|
| 3,271,771 | A | 9/1966 | Hannan et al. | 343/756 |
| 3,500,420 | A | 3/1970 | Pierrot | 343/756 |
| 4,652,891 | A | 3/1987 | Bossuet et al. | 343/909 |
| 4,728,961 | A | 3/1988 | Bossuet et al. | 343/756 |
| 5,053,785 | A | 10/1991 | Tilston et al. | 343/756 |
| 5,280,298 | A | 1/1994 | Morin | 343/909 |
| 6,417,813 | B1 | 7/2002 | Durham | 343/753 |
| 2014/0009365 | A1* | 1/2014 | Roy | H01Q 15/24 343/909 |

FOREIGN PATENT DOCUMENTS

| | | | |
|---|---|---|---|
| CA | 2062029 | 8/1993 | H01Q 15/22 |

OTHER PUBLICATIONS

J. E. Roy, L. Shafai, "Reciprocal Circular-Polarization-Selective Surface", Dec. 1996, IEEE Antennas and Propagation Magazine, vol. 38, No. 6, pp. 18-33.*

J.E. Roy and L. Shafai, "Reciprocal Circular-Polarization-Selective Surface", Dec. 1996, IEEE Antennas and Propagation Magazine, vol. 38, No. 6, pp. 18-33.*

W.V. Tilston, C. Cannon, Y. Sabourin and A. Hurd, A Polarization Selective Surface for Circular Polarization, DREO Contract #25V84-00198, TILTEK, Final Report, Mar. 30, 1986.

(Continued)

*Primary Examiner* — Hoang V Nguyen
*Assistant Examiner* — Hai Tran
(74) *Attorney, Agent, or Firm* — Teitelbaum & MacLean; Neil Teitelbaum; Doug MacLean

(57) ABSTRACT

The invention provides a reciprocal circular polarization selective surface (CPSS) formed of two mutually orthogonal arrays of linear dipoles disposed at opposite transverse CPSS faces, with opposing orthogonal dipoles individually connected by transmission lines, wherein adjacent dipoles are endwise coupled for enhancing CPSS performance. In one implementation, the CPSS comprises a two-dimensional array of cells with each cell composed of two separate crankwires positioned at two diagonally opposite corners of the cell so that the cell has a 2-fold rotational symmetry and endwise coupling of adjacent crankwires for enhanced performance at normal and oblique angles of incidence.

21 Claims, 14 Drawing Sheets

(56) References Cited

OTHER PUBLICATIONS

W.V. Tilston, T. Tralman and S.M. Khanna, "A Polarization Selective Surface for Circular Polarization", Proc. IEEE AP—Symposium, 1988, vol. II, pp. 762-765.
D.A. Tilston and J. Towne, Development of a 15 GHz Circular Polarization Selective Surface, DREO Contract #W7714-8-5651/01-SV, Final Report, 1989.
Y.L. Chow, Analytical Study of the Circular Polarization Selective Surfaces—7.75 and 15 GHz, DREO Contract #W7714-8-5652/01-SS, Final Report, Mar. 1990.
G.A. Morin, "A Simple Circular Polarization Selective Surface (CPSS)", Digest of IEEE AP-S International Symposium, Merging technologies for the 90's, May 1990, vol. 1, pp. 100-103.
Jasmin E. Roy, Jafar Shaker and Lot Shafai, Theoretical Study of a Circularly Polarized Symmetric Cassegrain Antenna using a CPSS Subreflector, DREO Contract #W7714-0-9439/01-SS, Final report, Mar. 31, 1992.
S. Mener, R. Gillard, R. Sauleau, C. Cheymol and P. Potier, "Design and Characterisation of a CPSS-Based Unit-Cell for Circularly Polarized Reflectarray Applications", IEEE Trans. on AP-S, vol. 61, No. 4, Apr. 2013, pp. 2313-2318.
G.A. Morin, A circular polarization selective surface made of resonant helices, Defence Research Establishment Ottawa, Report No. 1269, Nov. 1995, pp. 1-37.
Jasmin E. Roy, Reciprocal Circular Polarization Selective Surface, Ph.D. dissertation, Department of Electrical and Computer Engineering, University of Manitoba, Manitoba, Canada, 1995.
Jasmin E. Roy, and L. Shafai, "Reciprocal Circular-Polarization-Selective Surface", IEEE Antennas and Propagation Magazine, vol. 38, No. 6, Dec. 1996, pp. 18-33.
Etienne Girard and Raphaël Gillard, Simulation de sources déphaseuses en double polarisation circulaire, Rapport d'études bibliographiques, IRER, Projet RNRT ARRESAT, Feb. 18, 2000.
V. Fusco and B. Nair, "Circular polarization selective surface characterization and advanced applications", IEE Proceedings H: Microwaves, Antennas and Propagation. vol. 153, No. 3, 2006, pp. 247-252.
I-Young Tarn and Shyh-Jong Chung, "A New Advance in Circular Polarization Selective Surface—A Three Layered CPSS Without Vertical Conductive Segments", IEEE Transactions on Antennas and Propagation, vol. 55, No. 2, Feb. 2007, pp. 460-467.
Jasmin E. Roy, "New Analysis of a Reciprocal Left Hand Circular Polarization Selective Surface (LHCPSS)", IEEE Antennas and Propagation Society International Symposium, Charleston, South Carolina, USA, Jun. 1-5, 2009, paper #204.4.
M.A. Joyal and J.J. Laurin, "A Cascaded Circular-Polarization-Selective Surface at K band", digest of the 2011 IEEE Int. Antennas Propagat. Symp., Spokane, Washington, Jul. 3-8, 2011, pp. 2657-2660.
Juanjo Sanz-Fernandez, Elena Saenz, Peter de Maagt, and Cyril Mangenot, "Circular Polarization Selective Surface for Dual-Optics CP Offset Reflector Antennas in Ku-band", Proceedings of the 6th European Conference on Antennas and Propagation (EUCAP), Prague, Czech Republic, Mar. 2012, pp. 2683-2687.
Simon Mener, Raphael Gillard, Ronan Sauleau, Cecile Cheymol, and Patrick Potier, "A CPSS-based Reflectarray Cell with Reconfigurable Capabilities", Proceedings of the 6th European Conference Antennas and Propagation (EUCAP), Prague, Czech Republic, Mar. 26-30, 2012.
Simon Mener, Raphael Gillard, Ronan Sauleau, Cecile Cheymol, and Patrick Potier, "Design of a CPSS-based Reflectarray Cell with Controllable Reflected Phase for Dual Circularly Polarized Reflecatarrays", Proceedings of the 15th International Symposium on Antenna Technology and Applied Electromagnetics, Toulouse, France, Jun. 25-28, 2012.
Jasmin E. Roy, "A New CPSS Element", IEEE Antennas and Propagation Society International Symposium, Chicago, Illinois, USA, Jul. 8-14, 2012, Session 364.2.
Teemu Niemi, Antti O. Karilainen, and Sergei A. Tretyakov, "Synthesis of Polarization Transformers", IEEE Trans. Antennas Propagat., vol. 61, No. 6, Jun. 2013, pp. 3102-3111.
Jasmin E. Roy, "A Numerical Technique for Computing the Values of Plane Wave Scattering Coefficients of a General Scatterer", IEEE Trans. Antennas Propagat., vol. AP 57, No. 12, Dec. 2009, pp. 3868-3881.
Jasmin E. Roy, "On Using a Closed Box as the Integration Surface with the FDTD Method", IEEE Trans. Antennas Propagat., vol. 60, No. 5, May 2012, pp. 2375-2379.
J.E. Roy and L. Shafai, "Generalized scattering matrix and symmetry principles for infinite planar structures", Can. J. Phys. 75, 1997, pp. 413-431.
D.G. Michelson and E.V. Jull, "Depolarizing Trihedral Corner Reflectors for Radar Navigation and Remote Sensing", IEEE Trans. on Antennas and Propagation., vol. 43, No. 5, May 1995, pp. 513-518.
"An Idea for Electromagnetic "Feedforward-Feedbackward" Media" by Moses et al. IEEE Transactions on Antennas and Propagation, vol. 47, No. 5, May 1999 pp. 918-928.

* cited by examiner $$\varphi_L = \varphi_R = \varphi_g \pm 90^o$$

RECIPROCAL CIRCULAR POLARIZATION SELECTIVE SURFACES AND ELEMENTS THEREOF

CROSS-REFERENCE TO RELATED APPLICATIONS

The present invention claims priority from U.S. Provisional Patent Application No. 61/669,978 filed Jul. 10, 2012, and U.S. Provisional Patent Application No. 61/669,409 filed Jul. 9, 2012, both of which are incorporated herein by reference.

TECHNICAL FIELD

The present invention generally relates to reciprocal circular polarization selective surfaces (CPSS), elements thereof and devices incorporating such surfaces, more specifically relates to CPSS incorporating crankwires with lateral electromagnetic coupling between their transverse segments, and is especially applicable to antennas and polarimetric radar systems.

BACKGROUND OF THE INVENTION

A Circular Polarization Selective Surface (CPSS) is a finite-thickness surface that predominately reflects one sense, or handedness, of a circular polarization (CP) of an incident electro-magnetic (EM) wave, and predominantly transmits an EM wave of the other sense of CP. An ideal reciprocal CPSS acts either as a mirror or a transparent window, depending on the sense of CP of the incident wave. A reciprocal CPSS is one for which the sense of CP of the predominantly reflected wave is the same as that of the incident wave. This is opposite to an ordinary reflection from an interface between two dielectric media or from a common metallic mirror, wherein the sense of the predominant CP of the reflected wave is opposite to that of the incident wave. Furthermore, the general operation of a reciprocal CPSS typically remains the same regardless of whether the CPSS is illuminated from one side or the other. In its simplest form, a prior art CPSS is a two-Dimensional (2D) periodic array of identical CPSS elements that lacks longitudinal reflection symmetry, is reciprocal, and with a Cartesian tiling configuration. In the context of this specification, the longitudinal direction is the direction that is normal to the CPSS and is the preferred direction of propagation of the incident wave. A CPSS is typically designed to CP-selectively reflect or transmit incident EM radiation of a particular frequency f, which is referred to hereinafter as the operating frequency, or simply the frequency.

U.S. Pat. No. 3,500,420 issued to Pierrot discloses an example of a CPSS reflector, wherein the main element is a crankwire that is illustrated in FIG. 1. Here, a crankwire is a conductive wire that is bent to be comprised of 3 mutually perpendicular conducting segments. In the Pierrot design, the lengths of two perpendicular end segments, which are also referred to herein as transverse segments, is $3\lambda/8$, while the length of the middle, or longitudinal, segment is $\lambda/4$, with the total length of the crankwire equal to one wavelength $\lambda$. The relative orientation of the two transverse segments, i.e. the handedness of the geometry, dictates the operation of the CPSS element as to which sense of CP will be reflected upon being illuminated with a CP plane wave incident in the normal direction, i.e. a direction parallel with the longitudinal segment. Using Cartesian notation, when the longitudinal segment is aligned with the Z direction as illustrated in FIG. 1, the bottom transverse segment is aligned with the +X direction and the top transverse segment is aligned with the +Y direction, the crankwire reflects Left-Hand Circular Polarization (LHCP) when illuminated from the top or bottom, and a corresponding CPSS is referred to as a LHCPSS. With the top transverse segment aligned with the +X direction and the bottom transverse segment aligned with the +Y direction, the crankwire reflects Right-Hand Circular Polarization (RHCP) when illuminated from the top or bottom, and a corresponding CPSS is referred to as a RHCPSS. The crankwire has the same general operation whether it is illuminated from one end of its longitudinal axis or the other.

The operation of Pierrot's crankwire under normal incidence is as follows. Because the two transverse segments are orthogonal to one another, the EM coupling between them is negligible. Hence, one transverse segment does not create EM blockage for the other transverse segment as the incident wave propagates at normal incidence through the cell. Due to the $\lambda/4$ separation between the two perpendicular transverse segments, a normally incident plane wave of one sense of CP would induce two in-phase currents on the two transverse end-segments whereas a normally incident plane wave of the other sense of CP would induce two out-of-phase currents.

The two in-phase currents cooperate to produce a strong scattering response whereas the two out-of-phase currents nearly cancel one another to produce a weak scattering response. With the in-phase condition, the one-wavelength crankwire becomes resonant so that the current distribution over the entire length of the wire is sinusoidal-like, with a peak on each transverse segment and a null at the mid-point of the longitudinal segment. The relative orientation of the transverse segments that determines the handedness of the crankwire, and the $\lambda/4$ spacing between the transverse segments ensure that the sense of CP of the reflected wave is the same as that of the incident wave, as explained in more detail below. Hence, the reflected wave is strong and the sense of its CP is the same as that of the incident wave. In contrast, the total transmitted field is very weak because the transmitted scattered wave is equal and opposite to the incident wave, and because the total transmitted field is the vectorial summation of the incident wave and the scattered wave. With the out-of-phase condition, the two out-of-phase currents produce a bell shape current distribution with a small peak value at the mid-point of the longitudinal segment. Since this produces only a very weak scattering response, the incident wave goes through the crankwire with little or no disturbance as if the crankwire were absent.

In more specific terms, the operation of Pierrot's crankwire in FIG. 1 under normal incidence is as follows. The LHCP incident plane wave can be decomposed in two linearly polarized (LP) plane waves that propagate in the same direction (say, the −Z direction), with the two linear polarizations mutually orthogonal in space (one LP plane wave polarized with its E field along, say, the +X axis, and the other LP plane wave polarized with its E field along, say, the +Y axis) and phase shifted −90 degrees in time (the E field component along the +X axis varies as $\cos[\omega(t-t_0)]$ while the E field component along the +Y direction varies as $\sin[\omega(t-t_0)]$ wherein $t_0$ is an arbitrary time origin). The temporal period of the signal of radian frequency $\omega=2\pi f$ is T such that $(\omega T/4)=90$ degrees. At time $t=t_0$, the X-polarized wave at the top face of the cell has maximum value because $\cos[\omega(t-t_0)]=1$ but it propagates through the Y-parallel segment without interaction because it is orthogonal to the Y-parallel segment, and reaches at time $t=t_0+(T/4)$ the bottom face of the cell where it induces a =X-directed current on the X-parallel segment. At time $t=t_0$, the Y-polarized wave at the top face of the cell has zero value because $\sin[\omega(t-t_0)]=0$ and induces no current on the Y-parallel segment. At time $t=t_0+(T/4)$, the Y-polarized wave at the top face of the cell has maximum value because $\sin[\omega(t-t_0)]=1$ and induces a negative Y-directed current on the Y-parallel segment. Hence, at $t=t_0+(T/4)$, the induced current is most intense on both transverse segments and corresponds to the sinusoidal current distribution of a 1λ long wire under resonance. Hence, when the induced current on the X-directed segment has the negative polarity given by the −X direction, that on the Y-directed segment has the negative polarity given by the −Y direction. Thus, both induced currents are in-phase as one current pushes while the other one pulls on charges. In contrast, when the incident plane wave is polarized RHCP, the E field component along the +X axis varies as $\cos[\omega(t-t_0)]$ while the E field component along the +Y direction varies as $-\sin[\omega(t-t_0)]$. Again, at time $t=t_0$, the X-polarized wave at the top face of the cell has maximum value because $\cos[\omega(t-t_0)]=1$ but it propagates through the Y-parallel segment without interaction because it is orthogonal to the Y-parallel segment, and reaches at time $t=t_0+(T/4)$ the bottom face of the cell where it induces a −X-directed current on the X-parallel segment. At time $t=t_0$, the Y-polarized wave at the top face of the cell has zero value because $-\sin[\omega(t-t_0)]=0$ and induces no current on the Y-parallel segment. At time $t=t_0+(T/4)$, the Y-polarized wave at the top face of the cell has maximum negative value because $-\sin[\omega(t-t_1)]=-1$ and induces a +Y-directed current on the Y-parallel segment. Hence, at $t=t_0+(T/4)$, the induced current on the X-directed segment has the negative polarity given by the −X direction while that on the Y-directed segment has the positive polarity given by the +Y direction. Thus, both induced currents are out-of-phase as both currents attempt to push or pull on the charges simultaneously. In practice, the residual current is not exactly zero and its distribution along the wire has a bell-like shape to it.

Different variations of the Pierrot design have been disclosed, including ones using printed circuit boards with metalized via holes to implement the crankwires. One variation of Pierrot design is disclosed in an article by I-Young Tarn and Shyh-Jong Chung, "A New Advance in Circular Polarization Selective Surface—A Three Layered CPSS Without Vertical Conductive Segments", IEEE Transactions on Antennas and Propagation, Vol. 55, No. 2, February 2007, pp. 460-467. It involves using the Printed Circuit Board (PCB) technology to implement the crankwires, with the metallized via-holes that realizes the longitudinal segments of the crankwires being replaced by conducting traces on intermediate layers between the top and bottom surfaces of the PCB. Due to the partial vertical alignment of one strip with the strip on the next layer, the EM energy flows vertically from one strip to the other by capacitive coupling. This permits to electrically connect the two transverse segments of the crankwire without using a continuous conductor between them.

One drawback of CPSS of the Pierrot type composed of a periodic array of the crankwires of the same handedness is that its performance is satisfactory only at or near normal incidence, and quickly degrades with oblique incidence.

This issue is addressed by U.S. Pat. No. 5,053,785 to Tilston et al, which is incorporated herein by reference and which discloses a CPSS element 20 in the form of a dipole arrangement that is illustrated in FIG. 2, and which has a 2-fold rotational symmetry. The CPSS element 20 of Tilston includes two perpendicular half-wavelength dipoles 22 and 24 separated physically by a λ/4 spacing but connected electrically by a λ/2 transmission line 30. The operation of Tilston's design is as follows. Due to the λ/4 separation between the two perpendicular transverse dipoles 22, 24, a normally incident plane wave would induce currents on the two perpendicular dipoles 22, 24 such that the two voltage travelling waves present at the two opposite ends of the transmission line would be equal in magnitude but in-phase for one sense of CP, and out-of-phase for the other sense of CP of the incident wave. The induced currents are equal in magnitude because the EM coupling between the two perpendicular dipoles is very weak, owing to the dipoles being mutually perpendicular. Hence, one dipole does not create EM blockage for the other dipole as the incident wave propagates through the cell. From the longitudinal symmetry of the transmission line 30, the two equal-magnitude in-phase voltage travelling waves at the two opposite ends of the transmission line produce a virtual open-circuit at the mid-point of the transmission line whereas the two equal-magnitude out-of-phase voltage travelling waves produce a virtual short-circuit at the mid-point. Since the transmission line is electrically a half-wavelength long, a virtual short-circuit at the mid-point of the transmission line is transformed through a λ/4 transmission line into an open-circuit at the port of each perpendicular dipole connected at each end of the transmission line, and conversely, a virtual open-circuit at the mid-point is transformed into a short-circuit. The orthogonal half-wavelength dipoles produce a strong scattering response when their terminals are short-circuited because each dipole acquires a resonance length of a half-wavelength. In contrast, the two orthogonal half-wavelength dipoles produce a weak scattering response when their terminals are open-circuited because each dipole is segmented into two non-resonant λ/4 wires. The sense of the CP that is reflected for Tilston's design depends on the connection of the longitudinal transmission line to the two dipoles at its two ends. In fact, this connection is the same as if Tilston's design were two "back-to-back" crankwires. Hence, the explanation for the sense of the CP being scattered for Tilston's design is the same as that which was given for Pierrot's crankwire since the fact that the lengths of the transverse segments are different between Pierrot's crankwire and Tilston's dipoles does not affect the sense of CP being scattered. One advantage of the Tilston's design is that is has a 2-fold rotational symmetry, which has been shown to provide a good performance under oblique incidence. Notably, U.S. Pat. No. 5,053,785 is silent as to possible solutions to a problem of incorporating the half-wavelength transmission line in the quarter-wavelength spacing that corresponds to the thickness of the cell, and further is silent on possible performance of the suggested design. Furthermore, the half-wavelength dipoles need to be rotated 45 degrees to lie on the diagonals of the cells in order to fit within cells that are no larger than a half-wavelength in order to avoid the formation of grating lobes and the presence of higher-order modes of propagation.

FIG. 3 illustrates another prior art CPSS that may be referred to as a CP-LP-CP cascade design, which is disclosed by U.S. Pat. No. 3,271,771 to P. W. Hannan et al. It includes a cascade of two circular polarizers of opposite handedness sandwiching a linear wire-grid polarizer. Its operation involves converting the input CP into a Linear Polarization (LP), filtering the LP with a wire grid and reconverting the output LP into CP. The CPSS operation would be changed from reflecting one sense of CP to reflecting the other sense of CP by rotating the wire grid by 90 degrees. One disadvantage of the cascade design is that its performance under oblique incidence is limited because the linear polarization filter works best only under normal incident EM illumination. Also, the realization of the CP-LP-CP cascade design is much thicker than those of Pierrot's or Tilston's designs, which is a disadvantage in terms of volume, weight and space.

An object of the present invention is to provide an improved CPSS which addresses at least some of the disadvantages of the prior art, and which provides improved performance in at least some applications.

SUMMARY OF THE INVENTION

Accordingly, the present invention relates to an improved CPSS that makes use of endwise EM coupling between transverse segments and which, in its preferred embodiment, integrates the longitudinal transmission line as part of the dielectric substrate of the CPSS.

One aspect of the invention provides a CPSS in the form of a two-dimensional array of cells, with each cell composed of two separate crankwires positioned at two diagonally opposite corners of the cell, each crankwire having a transverse segment in one of two faces of the CPSS, so that the cell has a 2-fold rotational symmetry about its centre axis that is perpendicular to the faces, wherein the array forms a quarter-wavelength thick electromagnetic surface for an EM wave of a pre-determined operating frequency at normal incidence with respect to the two faces.

One aspect of the present invention relates to a CPSS that comprises a plurality of cells, each cell comprising two crankwires of the same handedness, each crankwire comprising a longitudinal segment electrically connecting two transverse segments, each of the segments being electrically conductive. Each of the crankwires of each cell are positioned adjacent the periphery of the cell so that the longitudinal segment of a first crankwire in a first cell is positioned adjacent to, and transversely aligned with, the longitudinal segment of a second crankwire in a second cell adjacent the first cell for coupling thereto so as to form a transmission line that is longitudinally oriented. One transverse segment of the first crankwire is disposed for endwise coupling with a nearest transverse segment of a crankwire in a third cell adjacent the first cell. The other transverse segment of the first crankwire is disposed for endwise coupling with a nearest transverse segment of a crankwire in a fourth cell adjacent the first cell.

Another feature of the present invention provides a CPSS that includes a substrate made of a dielectric material for supporting the crankwires, wherein the transverse segments of each crankwire are formed of conducting strips disposed on opposite faces of the substrate, and wherein the longitudinal segments are embedded in the dielectric material of the substrate, and wherein the substrate is shaped, such as corrugated, so that for a given frequency of a normally-incident electromagnetic wave, an electrical thickness of the substrate is substantially 90 degrees, an electrical length of the longitudinal transmission lines is substantially 180 degrees, and an electrical length of the transverse segments is substantially 90 degrees.

BRIEF DESCRIPTION OF THE DRAWINGS

The invention will be described in greater detail with reference to the accompanying drawings which represent preferred embodiments thereof, in which like elements are indicated with like reference numerals, and wherein.

DETAILED DESCRIPTION

Figure 1:
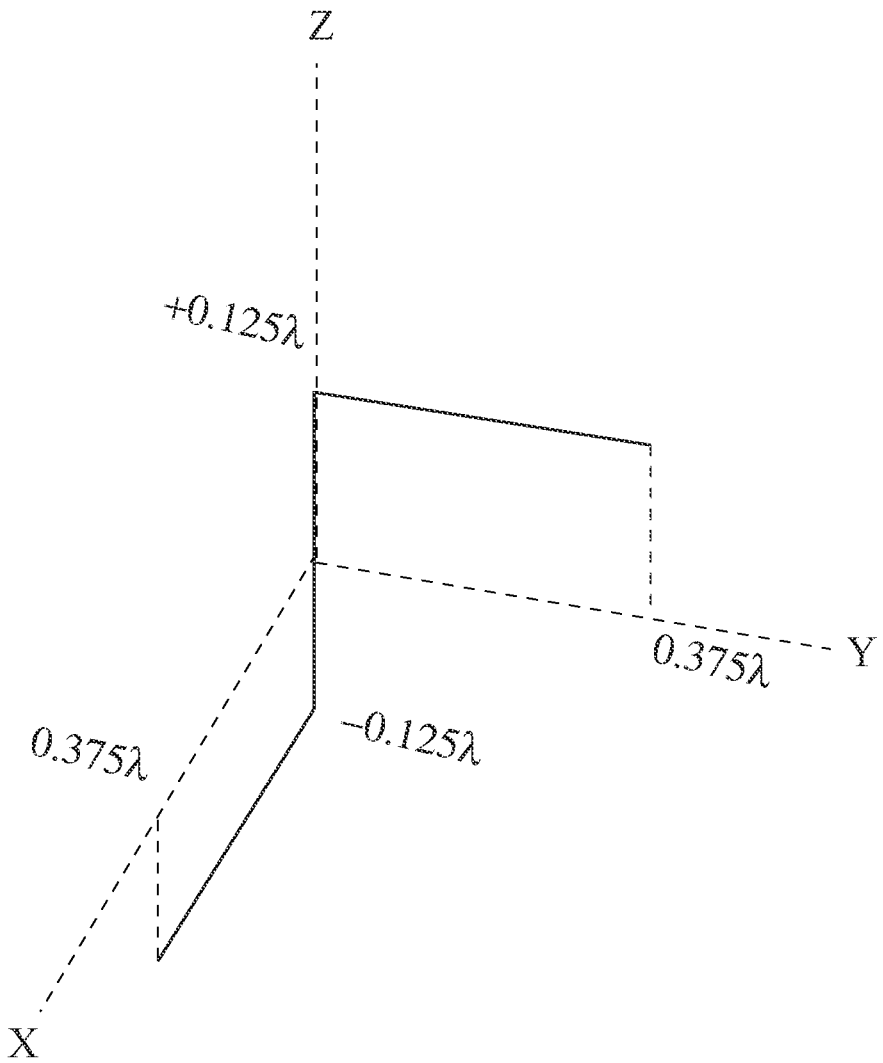
FIG. 1 (PRIOR ART)
FIG. 1 is a schematic diagram illustrating a prior art CPSS element in the form of a crankwire.
Figure 2:
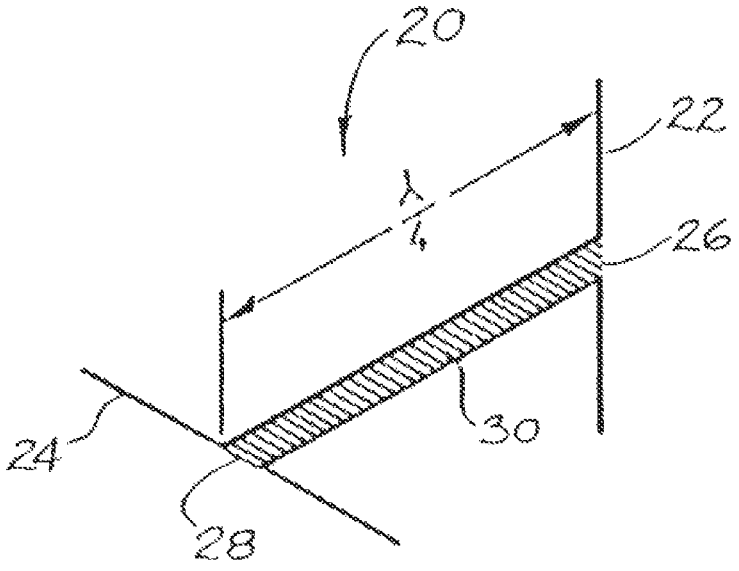
FIG. 2 (PRIOR ART)
FIG. 2 is a schematic diagram illustrating a prior art CPSS element in the form of a two orthogonal $\lambda/2$ dipoles connected by a $\lambda/4$ transmission line.
Figure 3:
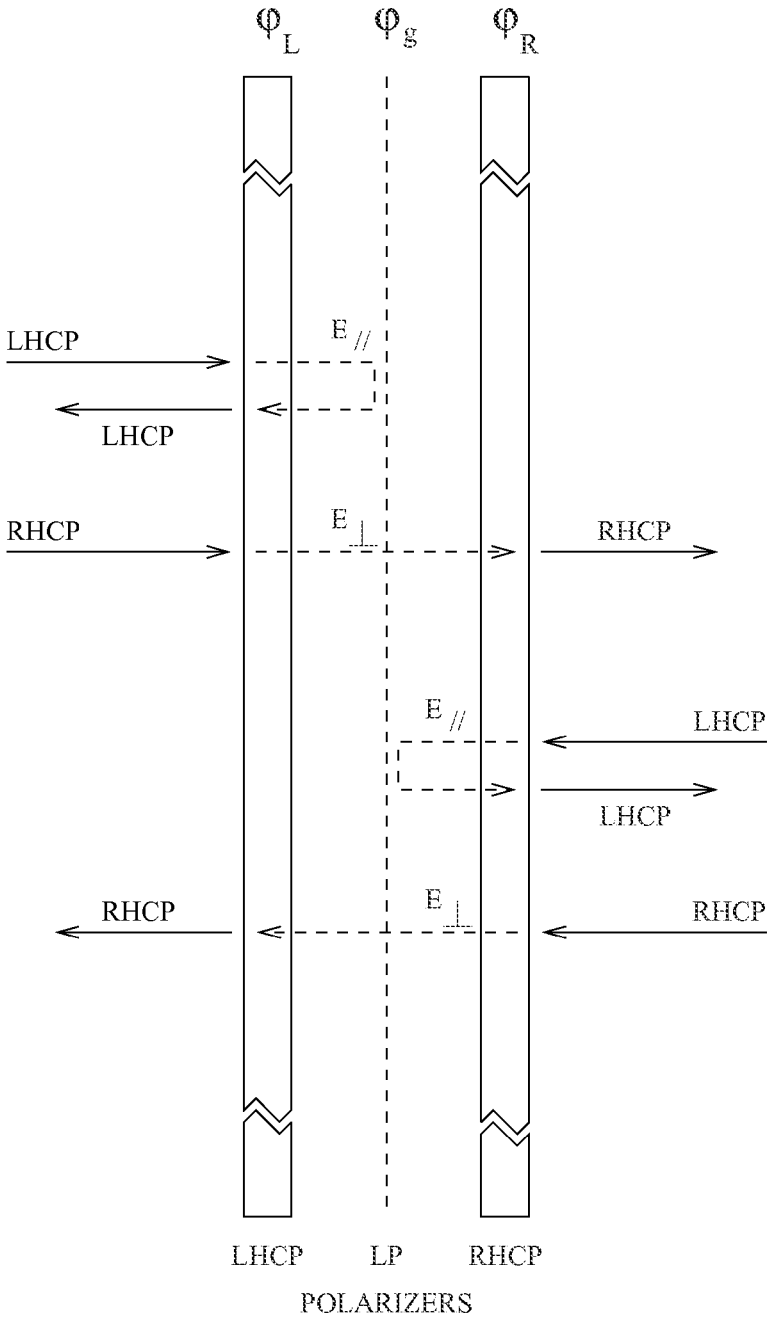
FIG. 3 (PRIOR ART)
FIG. 3 is a schematic diagram illustrating a prior art CPSS formed of two CP polarizers sandwiching a linear wire-grid polarizer.

In the following description, for purposes of explanation and not limitation, specific details are set forth, such as particular components, techniques, etc. in order to provide a thorough understanding of the present invention. However, it will be apparent to one skilled in the art that the present invention may be practiced in other embodiments that depart from these specific details. In other instances, detailed descriptions of well-known methods, devices, and circuits are omitted so as not to obscure the description of the present invention.

The following definitions are applicable to embodiments of the invention: the term crankwire refers to a conductor having three mutually perpendicular conductive segments that may have circular or non-circular cross-sections and may include a portion of a transmission line; the term 'Cartesian array' refers to a 2D array comprised of cells that are disposed in rows and columns; the term 'connected' means physically and/or electrically connected, while the term 'coupled' or 'couples' refers to the presence of EM coupling between two or more physically and electrically separate elements, unless specified otherwise; the term 'overlap' refers to a common length of two generally parallel segments, which extend besides each other over a portion of their length with a gap therebetween, and does not mean a physical connection; LHCP refers to the left sense of circular polarization, wherein the electric field vector of the wave rotates counter-clockwise about the propagation vector when looking in the direction of propagation; RHCP refers to the right sense of circular polarization, wherein the electric field vector of the wave rotates clockwise about the propagation vector when looking in the direction of propagation; LHCPSS refers to a CPSS for reflecting the left sense of circular polarization; RHCPSS refers to a CPSS for reflecting the right sense of circular polarization; the term 'electrical thickness' when used in relation to a substrate refers to a phase shift that an EM wave of the operating frequency undergoes when propagating through the substrate, and may be expressed in angular units or in terms of a fraction of an effective wavelength; similarly, the term 'electrical length' refers to a representation of a length in the propagation direction in terms of a propagation phase shift by an electrical signal of the operating frequency, wherein one full wavelength corresponds to 360 degree phase shift.

The incident EM radiation which is to be selectively reflected and transmitted by the CPSS is also referred to herein as 'wave', and its frequency f is referred to as the frequency of operation or the operating frequency. The term 'wavelength', also denoted as λ, refers to the effective wavelength corresponding to the operating frequency f within the CPSS and may depend on a direction of propagation of the EM radiation, as determined by a corresponding effective permittivity value.

Embodiments of the invention are described herein with reference to a Cartesian system of coordinate (X,Y,Z), wherein the Z axis is directed parallel to the middle segment of the crankwires, while the X and Y axes are directed parallel to the two end segments. A direction parallel to the Z axis is also a nominal direction of the wave incidence in operation, with the CPSS lying in a plane parallel to the XY plane. A direction parallel to the Z axis is also referred to herein as the longitudinal direction, whereas the directions parallel to the X or Y axes are referred to as the transverse or lateral directions. Accordingly, the middle segment of a crankwire is also referred to herein as the longitudinal segment (LS), while the end segments are also referred to herein as the transverse segments (TS). Two or more LSs are said to be aligned or 'transversely aligned' when their respective ends, and the TSs extending therefrom, are transversely aligned, i.e. lie in a same (X,Y) plane.

Note that as used herein, the terms "first", "second" and so forth are not intended to imply sequential ordering, but rather are intended to distinguish one element from another unless explicitly stated.

Figure 4:
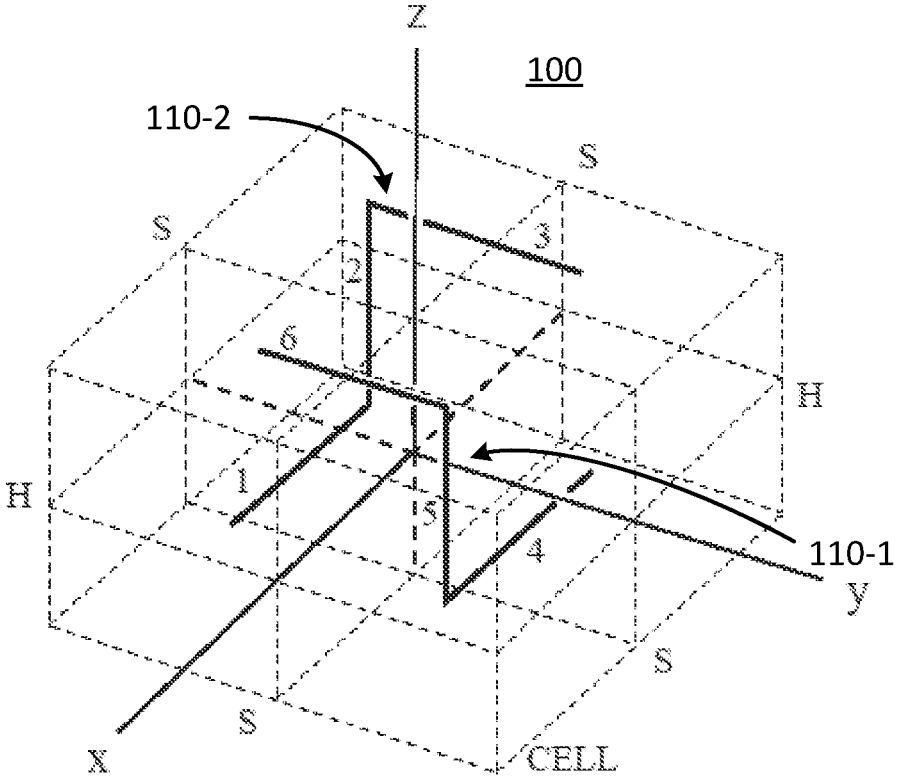
FIG. 4 is an isometric view of a CPSS cell of one embodiment of the present invention including two opposing crankwires.

Embodiments of the present invention will now be described first with reference to FIG. 4, which shows an exemplary LHCPSS cell 100. As described hereinbelow in further details, a CPSS of the present invention may include a plurality of such cells disposed side by side to form a 2D Cartesian array. The cell 100, which is generally of square shape and has transverse dimensions S and longitudinal dimension H, contains a double crankwire arrangement that is composed of crankwires 110-1 and 110-2 of the same handedness and is generally centered within the cell. The single crankwires 110-1 and 110-2, which are generally referred to as crankwires 110 and are shown with reference to the Cartesian coordinate system (X,Y,Z), are substantially identical in shape and size and disposed so as to confer a 2-fold rotational symmetry about the Z axis to the double crankwire. In FIG. 4, the middle or longitudinal segments (LS) of the crankwires are labeled '2' and '5', while their end segments are labeled '1' and '3', and '4' and '6', respectively.

In accordance with one aspect of the present invention, the individual crankwires 110-1 and 110-2 are disposed diagonally in opposing corners of the cell 100 near the cell periphery and have an opposite orientation of their respective transverse segments so as to confer a 2-fold rotational symmetry to the double crankwire, wherein each of the crankwires is substantially a copy of the other crankwire rotated 180 degrees about the Z axis passing through the center of the cell. Top TSs 3, 6 are co-planar defining a first face of cell 100, while bottom TSs 1 and 4 are also co-planar and define a second face of cell 100. We will also be referring to the first and second faces as the top (upper) and bottom (lower) faces, although it will be appreciated that all these designations are for convenience of the description only.

Figure 5:
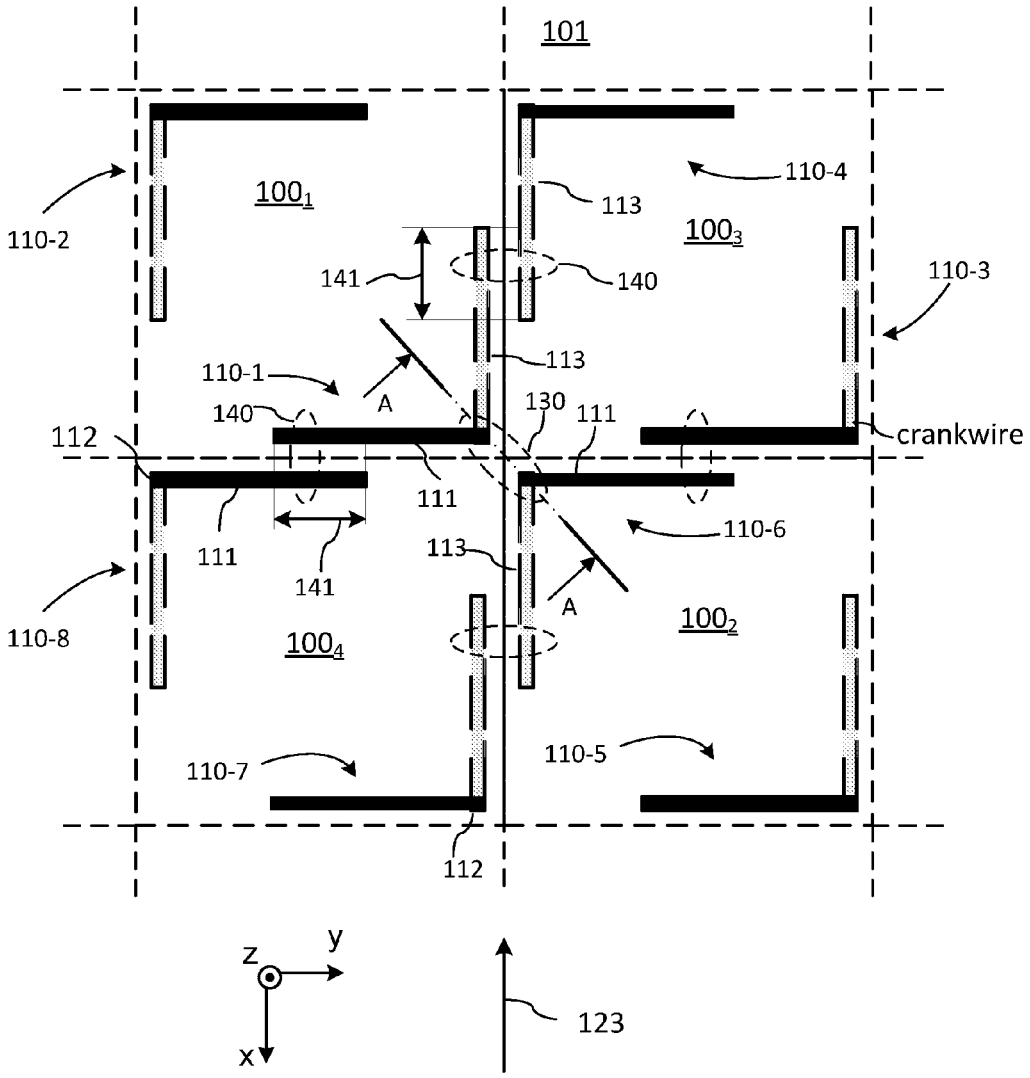
FIG. 5 is a schematic top view of a 2×2 CPSS array composed of the CPSS cells of FIG. 4 with endwise coupling between crankwires of adjacent cells.
Figure 6:
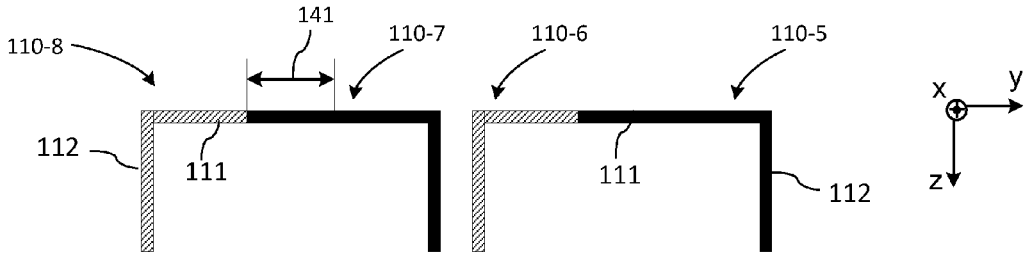
FIG. 6 is a side view of the 2×2 CPSS array of FIG. 5.

Turning now to FIGS. 5 and 6, there is illustrated, in top and side views respectively, a four-cell LHCPSS arrangement 101 for selectively reflecting LHCP waves of a pre-determined operating frequency f according to an embodiment of the present invention. Here four instances of cell 100, labeled '$\mathbf{100}_i$' with cell indices i spanning from 1 to 4, are arranged side-by-side in a 2×2 Cartesian array, with their first and second faces aligned to form a first and second face of the CPSS array 101.

FIG. 5 shows the top view of the array 101, which corresponds to looking at the array 100 of FIG. 4 from the top down in the −Z direction, while FIG. 6 shows the side view of the array 101 when viewed in the direction indicated by arrow 123 in FIG. 5. Each of the cells 100, includes two crankwires 110 that are positioned adjacent the periphery of the cell, so that a first cell $\mathbf{100}_1$ includes two crankwires 110-1 and 110-2, a second cell $\mathbf{100}_2$ includes two crankwires 110-5 and 110-6, a third cell $\mathbf{100}_3$ includes two crankwires 110-3 and 110-4, and a fourth cell $\mathbf{100}_4$ includes two crankwires 110-7 and 110-8. Upper TSs 111 of each cell that lie at the top, or first, face of the CPSS 101 are shown with solid black stripes, with dashed lines indicating the outlines of the lower TSs 113 that lie at the lower, or second, face of the CPSS 101.

Figure 7:
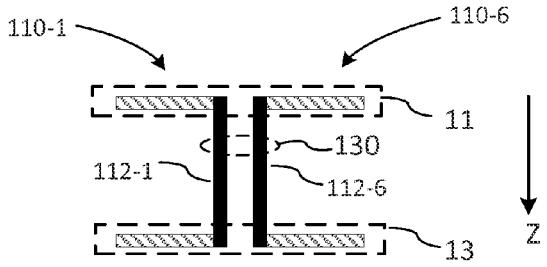
FIG. 7 is a partial cross-sectional view of the 2×2 CPSS array of FIG. 5 along the AA line showing a longitudinal transmission line formed by two longitudinal crankwire segments.

The LSs 112 extend in the direction normal to the plane of the FIG. 5 at the virtual intersections of the TSs of each crankwire. Referring also to FIG. 7, which illustrates a partial side view of the CPSS 101 in an "A-A" cross-section indicated in FIG. 5, the longitudinal segment 112-1 of the first crankwire 110-1 of the first cell $\mathbf{100}_1$ is transversely aligned with the longitudinal segment 112-6 of the second crankwire 110-6 of the second cell $\mathbf{100}_2$ and is positioned in close proximity thereto so as to ensure that these two adjacent LSs 112-1 and 112-6 are electromagnetically (EM) coupled to each other and together form a longitudinally-oriented transmission line (TL) 130, which is also referred to herein as the longitudinal TL.

In accordance with an aspect of the present invention, one transverse segment 113 of the first crankwire 110-1 is disposed for endwise coupling with a nearest transverse segment 113 of the crankwire 110-4 in the third cell $\mathbf{100}_3$ adjacent the first cell $\mathbf{100}_1$, and the other transverse segment 111 of the first crankwire 110-1 is disposed for endwise coupling with a nearest transverse segment 111 of the crankwire 110-8 in the fourth cell $\mathbf{100}_4$ adjacent the first cell $\mathbf{100}_1$. Similarly, each of the transverse segments 111 and 113 of the second crankwire 110-6 of the second cell $\mathbf{100}_2$ is endwise coupling with a nearest co-planar transverse segment 111 and 113, respectively, of one of the crankwires 110-3 and 110-7 in the adjacent third cell $\mathbf{100}_3$ and adjacent fourth cell $\mathbf{100}_4$, respectively.

Accordingly, the CPSS 101 of the present invention provides EM coupling not only between LSs of adjacent crankwires to provide longitudinal transmission lines, but additionally provides endwise EM coupling between TSs of adjacent cells, which will also be referred to herein as the transverse coupling or in-plane coupling. We found that this transverse coupling between CPSS cells is advantageous and substantially improves the CPSS performance, as described hereinbelow.

Figure 8:
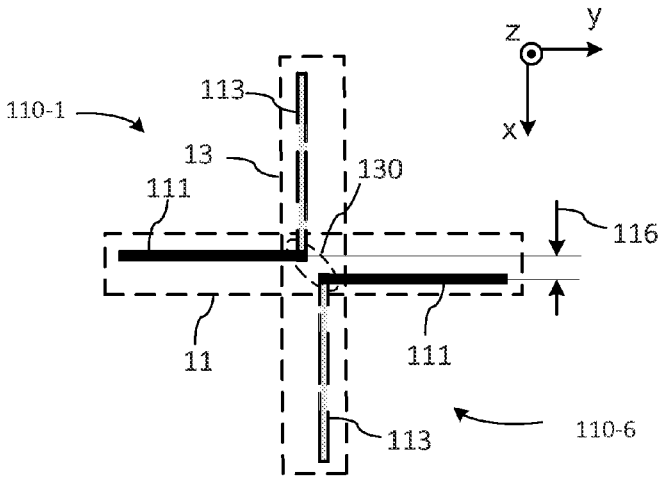
FIG. 8 is a schematic top view of a portion of a CPSS array showing two opposing offset dipoles, each formed of transverse segments of same two adjacent crankwires, which are connected by a longitudinal transmission line.

Turning now to FIG. 8 showing the two adjacent crankwires 110-1, 110-6 that are coupled at their longitudinal segments, the TL 130 can be viewed as connecting a dipole 11 formed of a pair of co-planar TSs 111 of the respective crankwires 110-1 and 110-6 to an orthogonally oriented dipole 13 formed of the other two co-planar TSs 113 of the same crankwires that lie at an opposite face of the CPSS array 101. The TSs forming a dipole will also be referred to herein as dipole arms. Taken individually, the orthogonal-dipole arrangement of FIG. 8 is similar in some respect to that disclosed by Tilston, and operates generally as described in U.S. Pat. No. 5,053,785, which is incorporated herein by reference. In particular, dimensions of the crankwire segments and parameters of the TL 130 are preferably selected so that the dipoles 11 and 13 are resonant at the operating frequency, i.e. have an electrical length of substantially 180° degrees or one half-wavelength, the electrical length of the TL 130 is also substantially 180 degrees or one half-wavelength, and the electrical distance between the dipoles 11 and 13 in the longitudinal direction is substantially 90 degrees or one quarter-wavelength. Here substantially means allowing for manufacturing tolerances and measurement accuracy. The condition for the dipoles 11, 13 to have the electrical length of 180 degrees or one half-wavelengths requires that each of the TSs have an electrical length of substantially 90 degrees, or one quarter-wavelength.

However, the dipoles 11, 13 that are shown in FIGS. 5, 7, 8 and 9 differ from the dipoles disclosed by Tilston in that the individual TSs forming the dipoles 11 and 13, i.e. the dipole arms, although preferably substantially parallel to each other, are not co-linear, but disposed with a lateral offset 116 with respect to each other. Accordingly, the dipoles 11 and 13 will also be referred to as offset dipoles. In the embodiment of FIGS. 4-8 this lateral offset, which results from the positioning of the crankwires in close proximity but slightly away from the edges of the CPSS cell, together with the suitable choice of the cell size S and the transverse segment length L, enables an endwise 'overlap' between end portions of the TSs near the boundary between adjacent cells, and enables the close endwise proximity of the TSs of the adjacent cells, resulting in the EM coupling therebetween.

Figure 9:
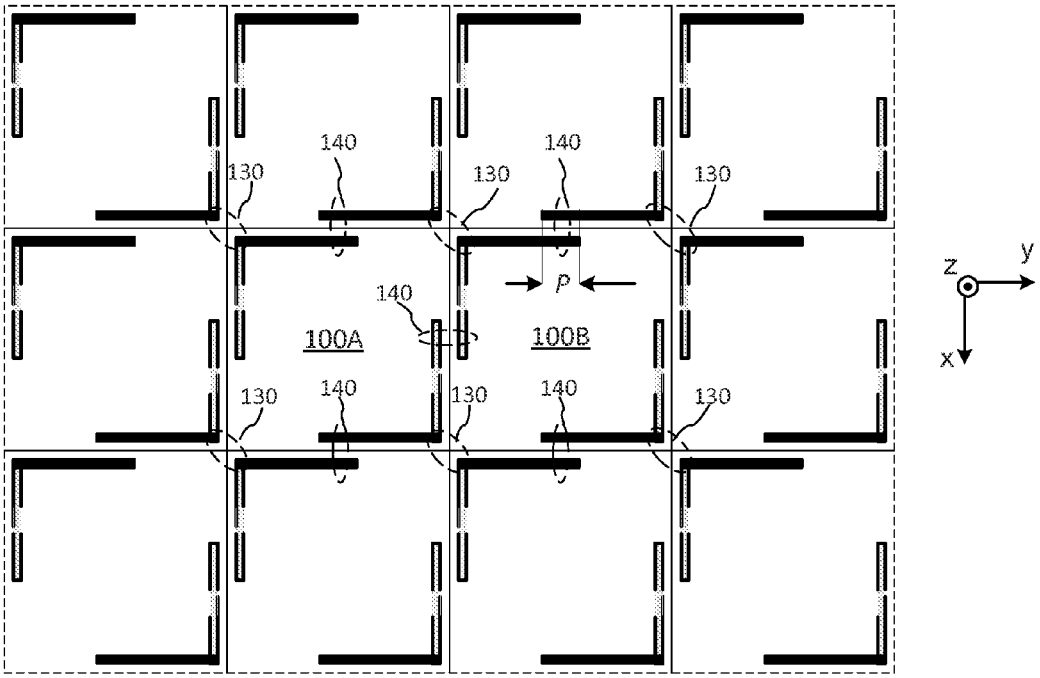
FIG. 9 is a schematic top view of a 3×4 CPSS array with endwise coupling and two inner cells.

Although FIG. 5 shows only 4 CPSS cells 100 wherein only two of the 8 crankwires are coupled at their respective LS to form the TL 130, preferred embodiments of the invention may include other cells extending the array 101 of FIG. 5 in all or some of the four directions along the X and Y axis, so that one or more of the cells are inner cells that are surrounded on all four sides by other cells 100. By way of example, FIG. 9 illustrates a 3×4 CPSS array having two inner cells 100A and 100B that are surrounded by 10 outer CPSS cells, with all cells being of the same type as cell 100. For the inner cells, each longitudinal segment of each crankwire forms a longitudinal transmission line 130 with a longitudinal segment of a closest crankwire in an adjacent cell, so as to form a plurality of longitudinal transmission lines 130 having an electrical length of a half-wavelength each, with each of the TLs 130 connecting two orthogonal dipoles 11 and 13.

Furthermore, each of the transverse segments 111, 113 of the inner cells is endwise coupled to a nearest transverse segment of a crankwire in an adjacent cell, forming a plurality of end-coupled pairs 140 of transverse segments, and hence a plurality of end-coupled dipoles 11 at one face of the array, and a plurality of end-coupled dipoles 13 at the other face of the array. Effectively, this endwise coupling of the TSs provides a capacitive loading of the dipoles 11 and 13, which positively contributes into the electrical length thereof. Advantageously, this makes the TSs of the optimal electrical length of 90 degrees, or one quarter-wavelength, physically smaller, thereby making the period of the array physically smaller and thereby making the CPSS array physically denser and smaller.

Figure 10:
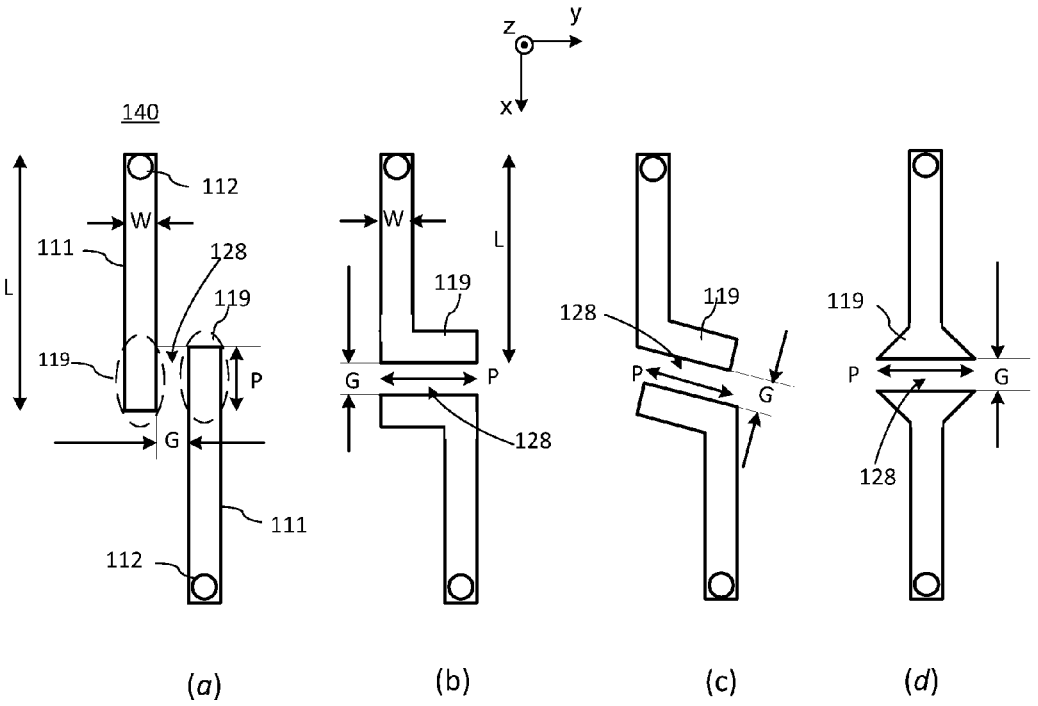
FIGS. 10(*a*) to (*d*) are schematic diagrams illustrating exemplary variants of endwise coupling between transverse segments of adjacent crankwires.

Referring now to FIGS. 10(*a*) to 10(*d*), the embodiments described hereinabove include TSs that are substantially straight, with the end portions 119 of the TSs of a same endwise pair 140 extending alongside each other over a coupling length P with a gap G therebetween, as illustrated in FIG. 10(*a*).

The present invention is not however limited to straight TSs that partially overlap lengthwise at the ends, but encompasses TSs having end portions of any suitable shape, relative position and/or orientation therebetween that provide the desired endwise EM coupling between the TSs of adjacent crankwires in adjacent cells, and hence between the crankwires themselves.

FIGS. 10(*b*)-(*d*) illustrate other examples of such end-coupling configurations wherein end portions 119 of the respective TSs, which are referred to herein also as the end-coupling portions 119, are shaped and/or positioned so as to be directly facing each other along a coupling length P with a suitably small gap G therebetween. In particular, FIGS. 10(*b*) and (*c*) illustrate an embodiment wherein the end-coupling portions 119 of the transverse segments are bent relative to the rest of their respective transverse segments, with FIG. 10(*b*) illustrating a 90 degrees bend, while FIG. 10 (*c*) illustrates an oblique angle bend of the TSs. This arrangement may be viewed as providing side-to-side coupling of the TSs along the bent ends thereof, and may also be viewed as providing effectively a version of an end-to-end coupling between the TSs, wherein end-faces of the TSs are asymmetrically widen and positioned in a close proximity facing each other to provide the desired coupling. FIG. 10 (*d*) illustrates an embodiment wherein the end-to-end coupling is provided by flared ends of the TSs. It will be appreciated that other designs of the end-coupling portions are also possible, such as for example, but not exclusively, end-to-end coupling designs which combine features of FIGS. 10(*b*) and 10(*d*) or 10(*c*) and 10(*d*), wherein the TS ends are asymmetrically flared. Note that in the context of the present specification the term 'endwise coupling' and its derivatives encompass both the side-to-side coupling and end-to-end coupling of the TSs and their variants and combinations, including but not limited to the embodiments illustrated in FIGS. 10(*a*)-(*d*). It will also be appreciated that the end faces of the TSs in the embodiments of FIGS. 10(*a*)-(*d*) do not have to be square but can be tapered, e.g. rounded, or generally of any suitable shape.

It will be also appreciated that, although FIGS. 4-9 illustrate arrangements wherein the CPSS is formed by side-by-side tiling in two dimensions of a CPSS cell that is substantially square and fully encompasses the double crankwire so as to provide a periodic 2D array, in other embodiments the cells may not be square, and/or may not fully encompass the two crankwires in their entirety, and/or the array may not be exactly periodic but instead have dimensions and/or orientation of the constituent elements that slightly vary from one cell to another, for example for the purpose of beam shaping. Furthermore, the CPSS cells may be arranged not to be flat but to follow a smoothly curved surface, for example, a concave or convex face of an antenna or another device or component.

Figure 11:
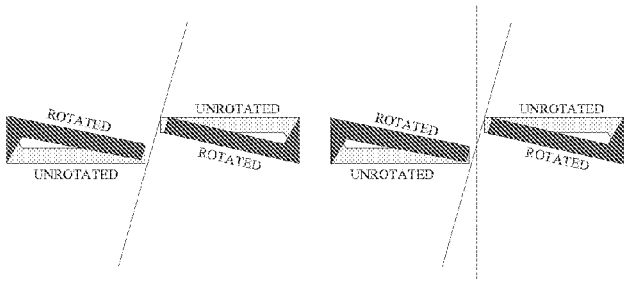
FIG. 11 is a schematic top view of a portion of a CPSS with rotated crankwires and end-to-end coupling.

One advantage of using a type of end-to-end EM coupling over using side-to-side EM coupling of straight TSs is that the end-to-end coupled TSs of FIGS. 10(*b*)-(*c*) can be slightly rotated about the z axis while still maintaining the end-to-end coupling by changing the shape or bending angle of the enlarged ends of the two coupled elements, as illustrated in FIG. 11 by way of example. This would be useful for designing a CPSS reflect-array or transmit-array whereby the elements of the reflect-array or transmit-array must scatter the incident wave with a slightly different phase shift from one element or cell to the next. This phase shift can be obtained by a mechanical rotation of the crankwires about the centre of their cell. Since the phase shift induced by the mechanical rotation is twice the angular value of the mechanical rotation, slight phase shifts can be accommodated with small mechanical rotations without losing the end-to-end coupling by changing the shape of the enlarged ends 119 as depicted in FIG. 11.

In one aspect, embodiments described hereinabove may be generally described as based on, or including, a plurality of endwise coupled double crankwires. They can also be described as including parallel chains of endwise coupled dipoles 11 and 13 disposed at two parallel faces of the CPSS in row-wise and column-wise orientations, respectively, wherein each of the diploes at one face is connected at midpoint with an orthogonally oriented dipole at the other face by a transmission line 130 that is generally orthogonal to the dipoles it connects. For optimum operation as CPSS elements, the electrical length of the TL should be equal or at least suitably close to λ\2, and the electrical length of the dipoles should be equal or at least suitably close to λ\2, which is achieved when the electrical length of the TSs is equal or close to λ\4. When adopting this view, the embodiments of FIGS. 5-10(*a*) with the side to side TS coupling can be obtained from the CPSS of Tilston by replacing Tilston's straight dipoles with the offset dipoles 11 and 13, and by sliding the dipoles towards each other until a desired end-wise overlap of the dipole arms is achieved.

One advantage of this 'offset/overlap sliding' is the increased density of the array, which now includes a greater number of CPSS elements than the prior art arrays without the endwise coupling of crankwires or dipoles, which may increase its efficiency in selective CP scattering. Furthermore, the resulting endwise EM coupling between the dipoles has the effect of adding a capacitive loading of their arms, which adds to its electrical length, thereby reducing the physical length of the dipole arms that is required for optimum operation of the CPSS. Thus, the added capacitive loading due to the endwise dipole coupling further decreases the size of the CPSS cell, thereby further increasing the CPSS density and efficiency. Note that the enhanced CPSS efficiency due to the CPSS cell reduction resulting from the capacitive loading is present also in the embodiment of FIG. 10(*d*), wherein the dipoles may be straight rather than offset, but wherein the capacitive loading due to the end-to-end coupling at the flared dipole ends results in the smaller dipoles and their greater density in the CPSS.

Furthermore, the endwise coupling effectively leads to a formation of an EM aperture between the opposing faces or sides of the TSs in the end-coupling portions thereof, as indicated at 128 in FIGS. 10(*a*)-(*d*). The EM radiation from the CPSS with end-wise coupling of the crankwires is thus a combination of EM radiation from the currents on the transverse segments and EM radiation from the apertures, each contribution being linearly polarized according to the orientation of its respective originator. With side-to-side coupling of FIG. 10*a*), the two orientations are orthogonal whereas with end-to-end coupling in FIG. 10*b* or 10*d*, the two orientations are parallel. The performance of the CPSS may thus be different, depending on the type of endwise coupling. With proper phasing of the 2 contributions, the presence of the apertures enhances the performance of the CPSS over what it would be without the presence of the apertures.

Figure 18:
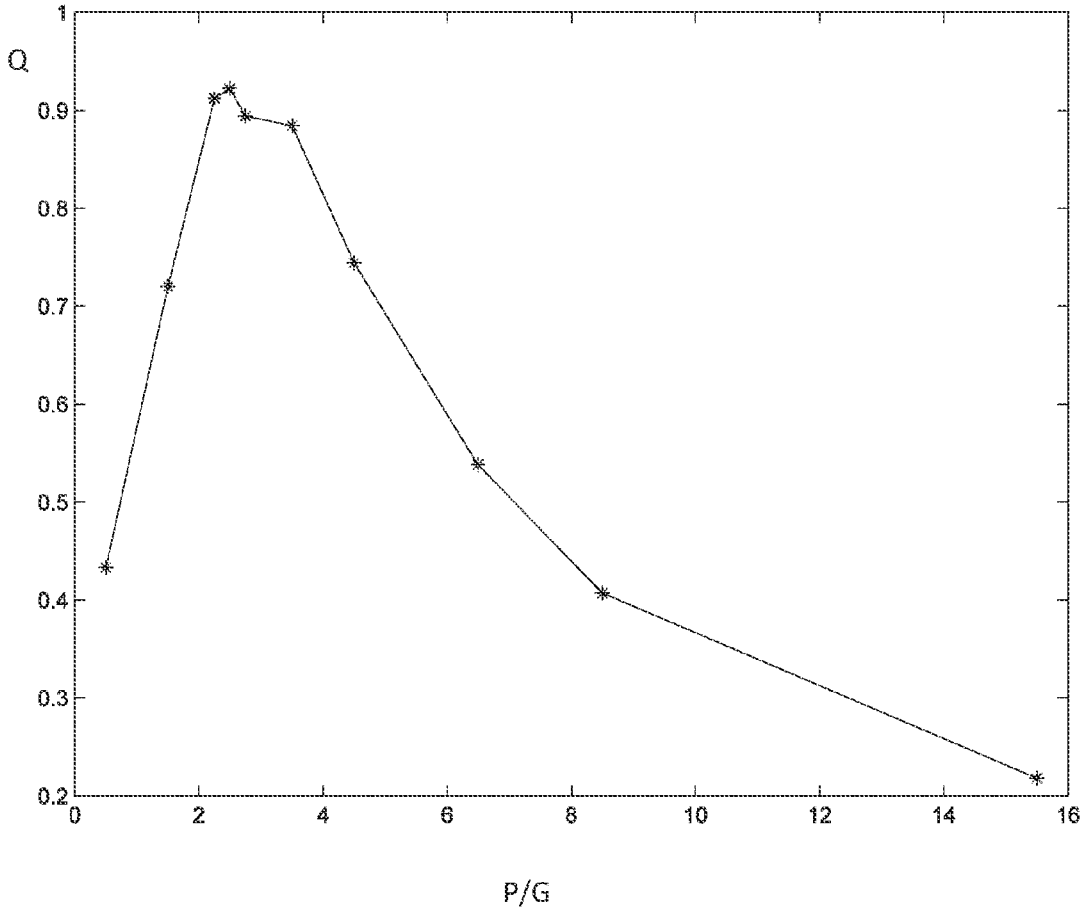
FIG. 18 is graph showing a dependence of the figure of merit Q, representing the CP selectivity of the CPSS, upon the ratio of the coupling length P to the coupling gap G for an exemplary 30×30 CPSS array.

In accordance with one aspect of the present invention, the strength of the endwise EM coupling between the crankwires, or equivalently between the respective dipoles, depends on the ratio C of the coupling length P to the gap G between the coupling faces of the respective TSs, C=P/G, which defines the aspect ratio of the aperture 128, and is also a geometrical factor conventionally known to define the capacitance in a parallel-plate approximation. We found that this ratio should be at least 0.5, and preferably at least 1. An optimal value for this ratio for a particular exemplary embodiment was found to be ranging from about 2 to about 4, as illustrated in FIG. 18 obtained with the results presented in Tables 1 and 2 below, with the CP selectivity of the CPSS falling off with C increasing beyond about 6 or 8. Notably, the electrical length value of the gap G should be less than λ/4, and preferably less than λ/8, and more preferably less than about L/4.

EXEMPLARY IMPLEMENTATIONS

Various embodiments of the CPSS of the present invention, such as those described hereinabove with reference to FIGS. 4-11, may be implemented in practice in a variety of way, which include for example free-standing orthogonal dipoles 11, 13 that are connected by a suitable TL, which may be for example in the form of a coaxial TL, which may be filled with a suitable dielectric to increase its electrical length. The TL may also be formed by the two longitudinal segments of two proximate crankwires as described hereinabove. In a preferred embodiment, the electrical length of the TL is λ/2, or 180°, while the transverse segments that lie at the opposing faces of the CPSS are separated by the electrical distance of λ/4, so as to ensure that the E field of the incident radiation experiences the 90° phase shift when propagating therebetween as desired for the reciprocal CPSS operation. Substantially, this requires that the phase velocity of the EM mode propagation in the TL be half of that of the incident EM wave throughout the rest of the CPSS.

In one exemplary embodiment, the conductors forming the crankwires may be considered to lie in free space, or surrounded by a material which permittivity is close to that of air, or etched on very thin low-loss Printed Circuit Board (PCB) substrates, such as by way of example DuPont AP8515R with $\in_r$=3.4 and loss tangent factor tan(δ)=0.003, supported by a material which permittivity is close to that of air such as by way of example, Rohacell 31 HF with $\in_r$=1.04 and loss tangent factor tan(δ)=0.0017, except the conductors 112 of the longitudinal transmission lines, which are embedded in dielectric cores of the transmission lines. Note that the term 'embedded' as used herein encompasses arrangements wherein the conductor is surrounded by the dielectric, either fully or partially, and arrangements wherein the dielectric is inside the conductor, such as for example when the conductors form a coaxial TL. When the conductors are inside the dielectric core, the volume of the dielectric core should preferably be large enough to contain most of the TEM (Transverse Electromagnetic Mode) field of the transmission line without affecting significantly the propagation velocity of the incident EM wave throughout the rest of the CPSS cell.

In one preferred embodiment, the CPSS includes a substrate that is made of a dielectric material for supporting the crankwires, wherein the two transverse segments of each crankwire are formed of conducting strips disposed on opposite faces of the substrate, and wherein the longitudinal segments are embedded in the dielectric material of the substrate. In one embodiment, the substrate is shaped so that, for an incident electromagnetic wave of a given frequency, an electrical thickness of the substrate is substantially 90 degrees, an electrical length of the longitudinal transmission lines is substantially 180 degrees, and an electrical length of the transverse segments is substantially 90 degrees. Notably, the electrical thickness of the substrate relates to an effective permittivity of the substrate in the longitudinal direction and represents an average over a plurality of cells. In one preferred embodiment, the value of the longitudinal effective relative permittivity $\in_r^{eff}$ for the corrugated substrate, the value of the relative permittivity $\in_r$ for the bulk dielectric material of the substrate, the substrate thickness H and the frequency of operation f=c/λ should preferably be chosen such that the following relationship holds:

$$H = \frac{\lambda / \sqrt{\varepsilon_r^{eff}}}{4} = \frac{\lambda / \sqrt{\varepsilon_r}}{2},$$

which leads to $\in_r^{eff}=\in_r/4$. For example, the choice of $\in_r=10.7$ and H=1.499 mm yields $\in_r^{eff}=2.675$ for f=30.57 GHz.

In one embodiment, the CPSS may be realized from a PCB substrate by corrugating, i.e. thinning or removing, the dielectric substrate mostly everywhere except in the immediate vicinity of the transmission line 130 where the substrate is left solid.

The corrugation of the substrate can be realized, for example, by drilling holes or making grooves or channels in the dielectric material of the PCB substrate, or thinning it in areas preferably a suitable distance away from the TLs 130. The corrugations may be implemented, for example, by machining channels in a PCB substrate.

Figure 12:
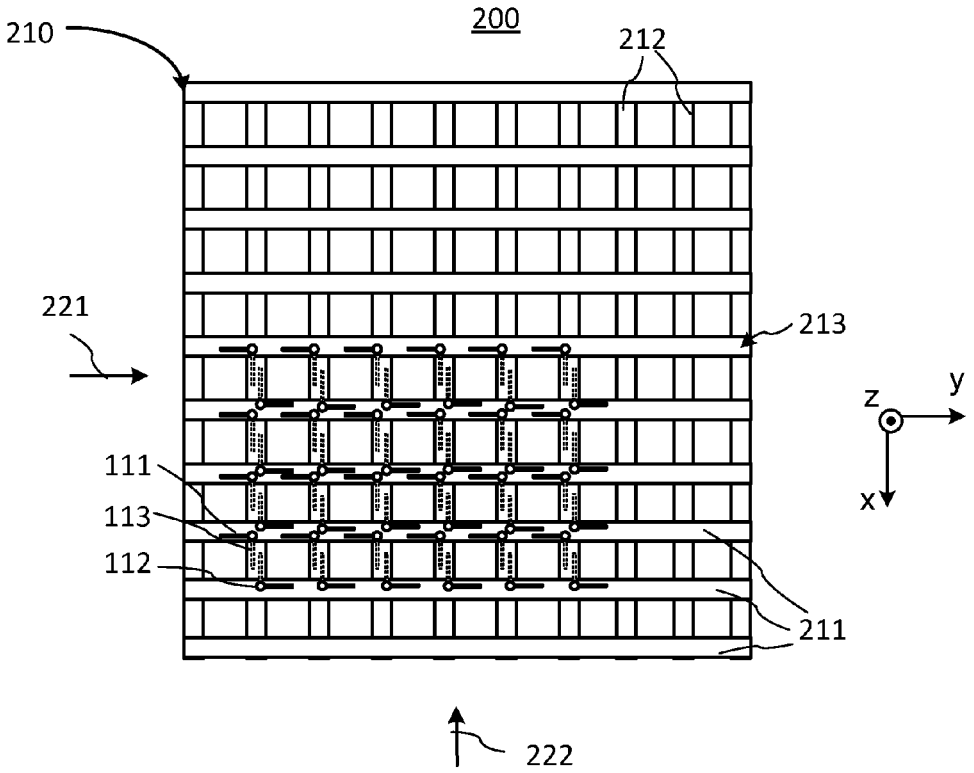
FIG. 12 is a schematic top view of a corrugated substrate composed of two sets of orthogonal beams supporting a CPSS array with a view of a portion of the array.
Figure 13:
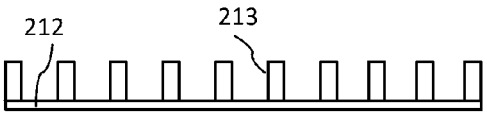
FIG. 13 is one side view of the corrugated substrate of FIG. 12.
Figure 14:
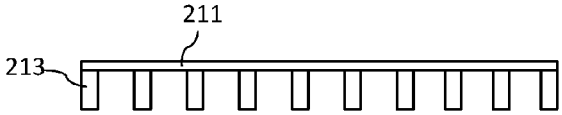
FIG. 14 is another side view of the corrugated substrate of FIG. 12.

With reference to FIGS. 12 to 14, there is illustrated, in top view, an embodiment of a RHCPSS 200 that is formed of two sets of parallel beams 211 and 212, with the beams 211 of one set disposed orthogonally to the beams 212 of the other set to form a rectangular grid, as illustrated in FIG. 12 in a plan view. The longitudinal segments 112 of the crankwires are embedded in dielectric cores 213 at beam intersections, which are also referred to herein as columns and which are best seen in FIGS. 13 and 14 showing elevation views of the CPSS 200 from directions indicated by arrows 221 and 222, respectively; these cores may be of circular, square, or other suitable cross-section. The transverse segments 111 and 113 of each crankwire are disposed upon the outer faces of the beams 211 and 212 of the first (211) and second (212) sets, respectively, extending from the beam intersection along the respective beams. The longitudinal segments 112 may be implemented, for example, as metallized via holes extending through the cores 213 and electrically connecting the respective TSs 111 and 113. In some embodiments, the beams 211, 212 may be sufficiently thick so that beams 211 lie directly on top of beams 212 without the cores 213.

The CPSS 200 may be fabricated, for example, by etching a PCB to produce the desired metallic pattern of TSs on both PCB faces and metallized via-holes, and in machining the dielectric substrate of the PCB from both sides at orthogonal directions to form the two sets of beams or ridges supporting the metal stripes of the TSs. The depth and width of the groves between the ridges are selected so as to achieve the desired effective permittivity values in the transverse and longitudinal directions and in the vicinity of the cores that make the longitudinal transmission lines appear to be a half-wavelength long within a physical spacing of effectively a quarter-wavelength long.

A further advantage in corrugating the PCB substrate is that the corrugation helps to prevent the formation of surface waves whose presence would cause the amount of EM coupling to be different from that which is desired.

In one embodiment, to achieve a suitable substrate thickness, the overall substrate with copper foil on both faces could be fabricated from two equal thickness substrates that are subsequently glued together with the use of a thin bonding film, such as by way of example Arlon CuClad6250 with $\in_r=2.32$ and loss tangent factor tan(δ)=0.0013. Each half-thickness substrate would be devoid of copper foil on one face in order to allow machining precisely their thickness. The presence of the thin bonding film at mid-thickness would not perturb significantly the performance of the CPSS if the film was not too lossy electrically.

In one embodiment, the geometry of FIGS. 12-14 could be obtained by machining two series of parallel channels in the PCB substrate such that the channels machined from one face of the PCB were orthogonal to those machined from the other face of the PCB. The depth of each channel may be such that the intersection of the orthogonal channels results in a hollow structure. As the structure would become mechanically weak after machining one series of channels, an auxiliary mold resembling a bed of rectangular posts could be mated with the half-machined PCB substrate in order to provide mechanical strength during the machining of the second series of channels. The mold is removed after machining. Alternatively, the substrate could be 3D printed and conductive traces could be generated for example by exposure of the printed substrate to a tracing laser beam. If the resulting PCB structure needs to be rigid, the channels could be filled up with a low-loss low-permittivity dielectric material like Rohacell. Otherwise, depending on the type of substrate, the structure could be bent to some extent to be made to conform to smoothly curved contours.

One exemplary embodiment uses a commercially available non-reinforced PCB substrate that is reported to have a relative permittivity $\in_r=3$ and a loss tangent factor "tan(δ) =0.003" at an operating frequency f=10 GHz. Using a permittivity of 3 instead of 4 may have that advantage that the bulk of the substrate may become more anisotropic as the permittivity departs from the value of about 3. One advantage of not using a fiber-reinforced substrate is also to have a lower substrate anisotropy. However, embodiments may be envisioned that utilize the substrate anisotropy to improve the CPSS performance.

The following notations are used herein in the description of this and related embodiments and simulation results:

The length and width of the conducting strip that forms each transverse segment of a crankwire are denoted as L and W, respectively. Conducting strips embody the transverse segments in a CPSS that is fabricated with conventional PCB techniques, such as photolithography and chemical etching of a copper foil that is bound to one or both sides of a dielectric substrate.

The diameter of each cylindrical longitudinal segment of a crankwire is denoted as d. These segments can be fabricated, for example, as metallized, e.g. copper-plated, via holes through the PCB substrate.

The centre-to-centre separation distance along X or Y between the two cylindrical conductors of the longitudinal transmission line formed by the two longitudinal segments of two adjacent crankwires in two adjacent CPSS cells is denoted as D.

The period of the square array, i.e. the length and width of each square CPSS cell 100 of the 2D-periodic array of identical CPSS cells, is denoted as S.

The coupling length and the length of the separation gap, either side-to-side or end-to-end depending on the type of EM coupling between the parallel transverse segments of two adjacent crankwires in two adjacent CPSS cells, are denoted as P and G, respectively.

The end-to-end separation distance along X or Y between proximate ends of the two transverse segments of a same offset dipole, is denoted as U.

For the side-to-side endwise coupling configuration of FIGS. 4-10(*a*) the following relationship holds: S=(2L−P+U). The coupling gap G does not appear in this expression because the two parallel transverse segments of the two adjacent crankwires are side-by-side rather than end-to-end. In this embodiment the gap G refers to the separation distance between the two side-by-side parallel transverse segments. If each transverse segment is long enough, it overlaps with the other side-by-side transverse segment by an amount corresponding to the coupling length P.

For the end-to-end EM coupling of FIGS. 10(*b*) and (*d*), the following relationship holds: S=(2L+G+U). The coupling length P does not appear in this expression because the two parallel transverse segments are end-to-end rather than side-by-side. The coupling length P here refers to the length of the end-coupling portion of each transverse segment, such as the 90 degree bent section of FIG. 10(*b*). The bent end-coupling portions could be realized with or without bevelling or padding of the corner of the bend.

The case of EM coupling that would be achieved by a mixture of side-to-side and end-to-end coupling is also within the scope of this invention. Such a mixture might be realized by having the bent segments bent at an angle different than 90 degrees as illustrated in FIG. 10(*c*), or by flaring the ends of the TSs, either symmetrically as shown in FIG. 10(*d*), or asymmetrically.

In FIG. 8, each dipole 11 and 13 is formed of two transverse segments, which form the dipole arms and which are offset with respect to one another. If the arms of the dipole were aligned rather than being offset, the longitudinal segments 112 that together form the transmission line 130 would need to undergo, either continuously or abruptly, a twist totaling 90 degrees between the two ends of the transmission line. Advantageously, by offsetting the transverse arms, this twist may be avoided to ease the fabrication process. This offset 116 also permits to 'overlap' the transverse segments of two adjacent crankwires in two adjacent cells by "sliding" one transverse segment past the other as shown in FIGS. 5-10(*a*). The value of the lateral offset 116 between the centerlines of the two arms of an offset dipole is equal to the value of the gap G plus the value of the segment width W.

The presence of the dielectric bridges or beams on which the transverse segments reside causes the electrical dimensions for G, P, S and L to scale somewhat differently than the electrical dimensions for D and H because G, P, S and L depend on the local effective permittivity that the EM wave propagating on the transverse segments sees in the vicinity of the air-dielectric interface, whereas H depends on the large-scale effective permittivity that the incident wave sees, and D depends on the local effective permittivity that the wave propagating on the longitudinal transmission line sees. The effective permittivity that an EM wave sees is the permittivity of a uniform homogeneous isotropic dielectric material in which the wave would propagate with the same propagation velocity as in actual structure where the wave propagates through a mixture of different materials. Optimum values of the geometrical and material parameters may be determined by optimization with an EM simulator as generally known in the art for similar type of devices, without requiring the explicit knowledge of the three possibly different values of effective permittivity.

In one exemplary embodiment that used a corrugated substrate with a bulk permittivity $\in_r=3$, the dimensions of each square column was 3.8720 mm on each side. This is also the width of the dielectric beams that the columns support. The thickness of the dielectric beams was chosen to be about 0.9250 mm as a compromise between mechanical rigidity and the need to achieve the desired values of the three effective permittivities. Other choices of bridge thickness and width are possible but the structure should be optimized for each different choice of dimensions and dielectric materials so as to provide the desired electrical length of the TL and TSs, and the desired electrical thickness of the substrate.

Specific transverse geometrical parameters of the TL that determine its characteristic impedance may not be critical for the CPSS operation since a short-circuit is transformed into an open-circuit and vice-versa, for any finite value of the characteristic impedance, provided that the electrical length over which the impedance transformation is carried out is substantially $\lambda/4$. This can be easily seen from the following well-known expression for the input impedance $Z_{in}$:

$$Z_{in} = Z_o \frac{Z_L \cosh\gamma L + \sinh\gamma L}{Z_o \cosh\gamma L + Z_L \sinh\gamma L}$$

wherein $Z_0$ is the characteristic impedance of the transmission line, $Z_L$ is the load impedance, $\gamma$ is the propagation constant of the transmission line, and L here is the length over which the impedance transformation is carried out. Clearly, if $(\gamma L)=\pi/2$, then for any finite value of $Z_0$ we have $Z_{in}=\infty$ when $Z_L=0$, and $Z_{in}=0$ when $Z_L=\infty$. Therefore the performance of the CPSS may generally be insensitive to the type, or the precise cross-sectional dimensions, of the transmission line and there may be no requirement to match the input impedance of the offset dipoles to the characteristic impedance of the transmission line. However, the cross-sectional dimensions of the dielectric core of the transmission line does affect the value of the local effective permittivity as 'seen' by the EM wave propagating on the transmission line and thus, the electrical length $\gamma L$ of the TL. Tolerances in the actual permittivity and in the thickness of the dielectric substrate, and departure from the resonance frequency are other factors that can cause the electrical length of the TL not to be exactly $\pi/2$, in which case the values of $Z_0$ and $Z_L$ may affect the performance of the CPSS.

An optimum amount of the EM coupling and an optimal choice of the size of the CPSS cell may depend on a particular CPSS application, and could be identified using a suitable commercially available simulation software, for example such as ANSYS HFSS software that is available from ANSYS, Inc. or CST's Studio Suite that is available from CST of America®, Inc., that may be assisted as needed by simple experimentation as would be evident to those skilled in the art. Results provided hereinbelow are by way of example only and were obtained using an accurate software that uses a Finite Difference Time Domain (FDTD) full-wave EM solver, as described in the paper entitled "A Numerical Technique for Computing the Values of Plane Wave Scattering Coefficients of a General Scatterer", IEEE Trans. Antennas Propagat., Vol. AP 57, No. 12, December 2009, pp. 3868-3881, and in the paper entitled "On Using a Closed Box as the Integration Surface with the FDTD Method", IEEE Trans. Antennas Propagat., Vo. 60, No. 5, May 2012, pp. 2375-2379. Simulation results presented below are to demonstrate the contribution of at least some of the novel features of the invention to the performance of the reciprocal CPSS of the type illustrated in FIGS. 4-14. Simulations were performed for values of the CPSS period S less than λ/2, to avoid the formation of secondary lobes in the scattered field.

Figure 15:
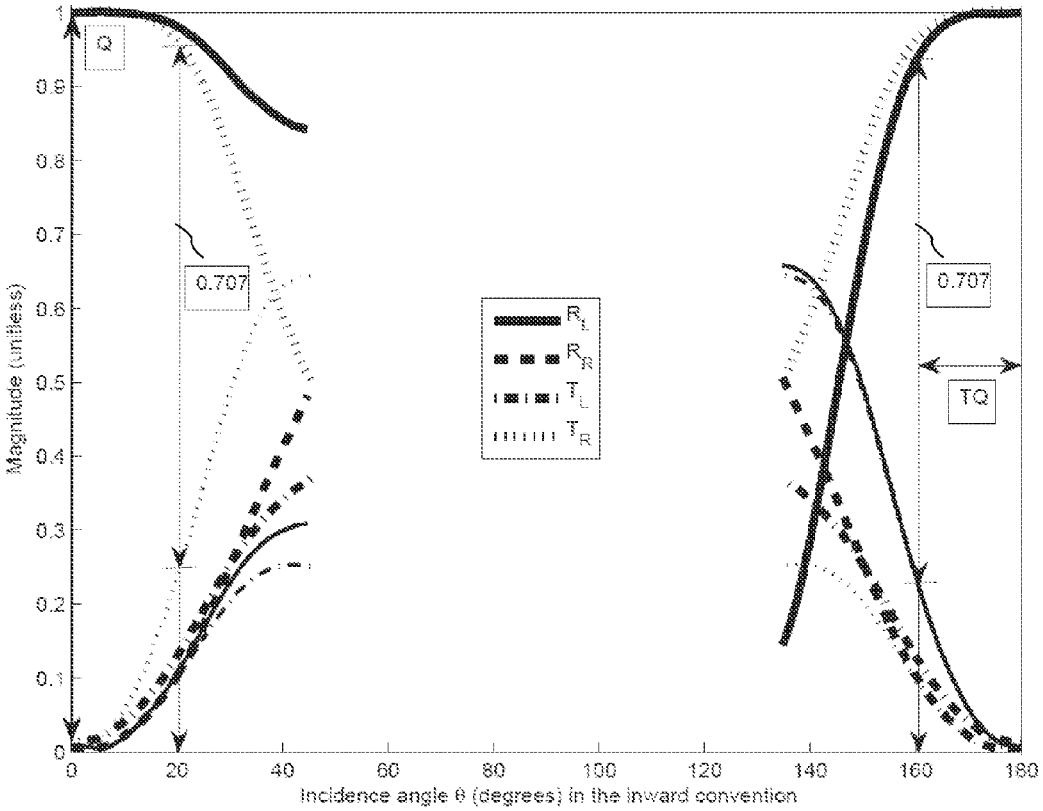
FIG. 15 is a graph showing simulation results, in a linear scale, for magnitudes of co-polarization and cross-polarization transmission and reflection coefficients in dependence on the angle of incidence for an exemplary embodiment of a 36×36 CPSS.
Figure 16:
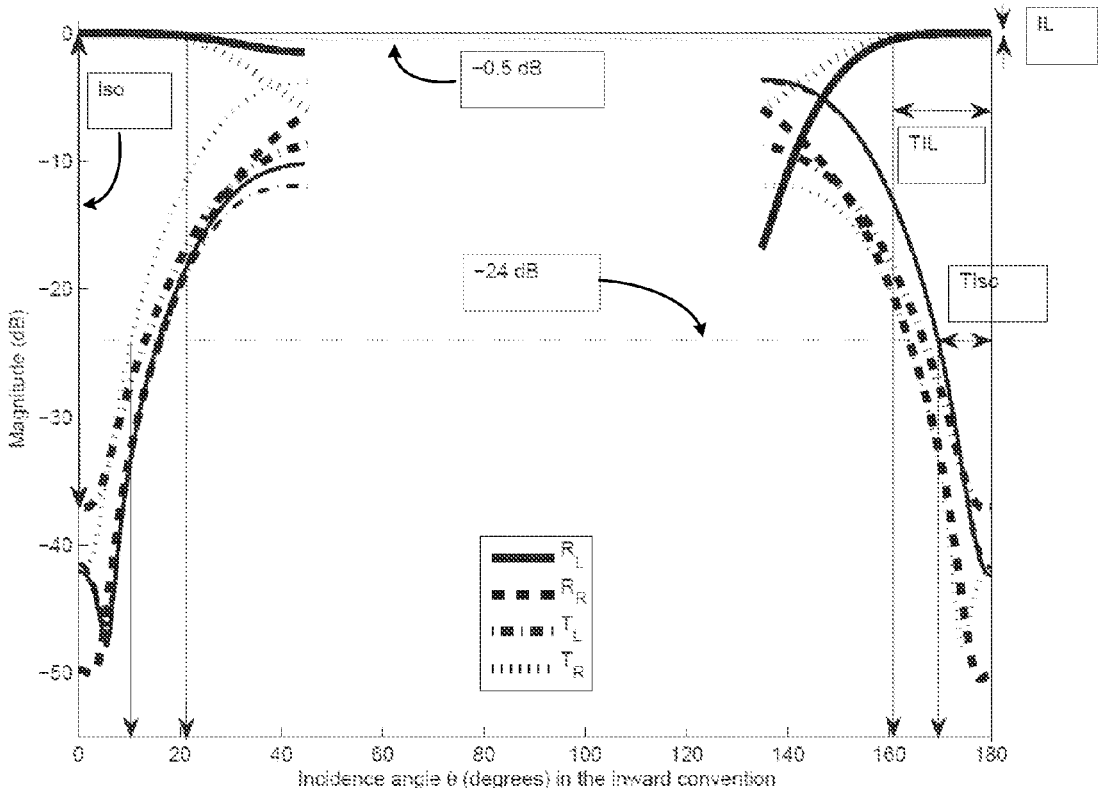
FIG. 16 is a graph showing same angular dependencies of the magnitudes of co-polarization and cross-polarization transmission and reflection coefficients as in FIG. 15 in a logarithmic scale.
Figure 17:
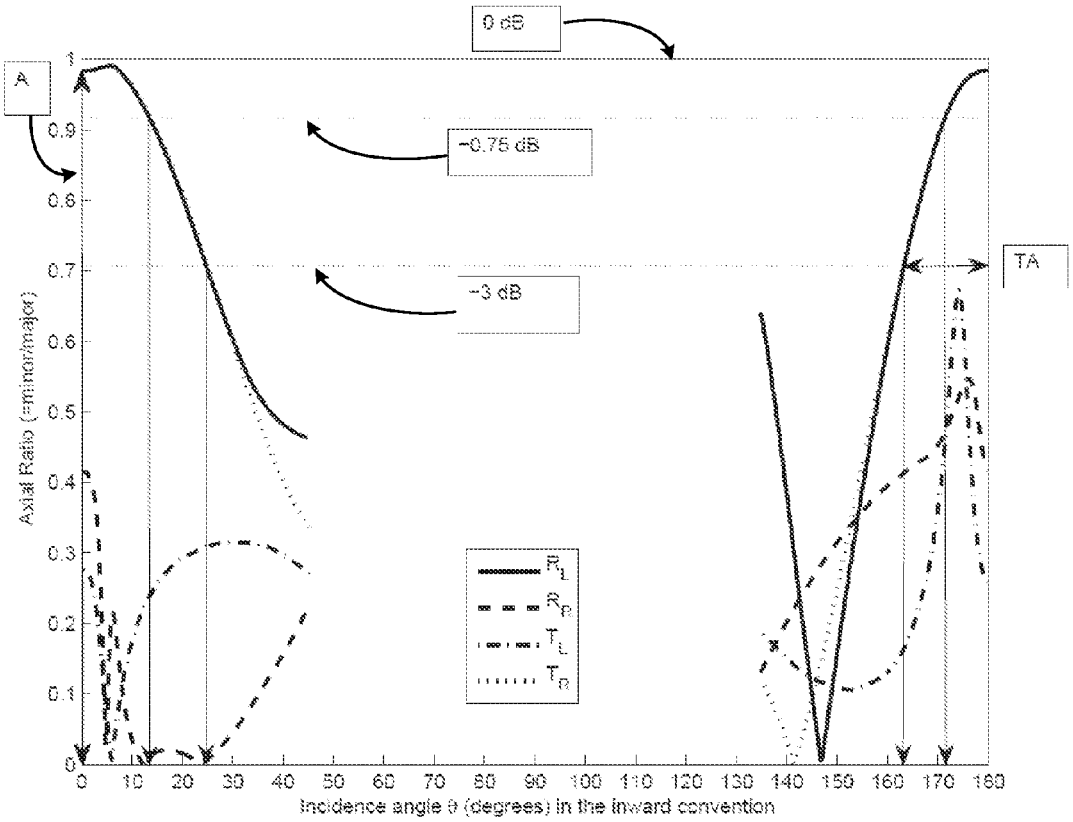
FIG. 17 is a graph showing the simulation results in term of an axial ratio of the elliptical polarization of reflected and transmitted radiation for LHCP and RHCP incident radiation in dependence on the angle of incidence for the 36×36 CPSS array of FIGS. 15 and 16.

FIGS. 15-17 present simulations results illustrating a performance for a 36×36 LHCPSS, with side-to-side EM coupling between the transverse segments, using the corrugated substrate with a relative permittivity of 3 and square cross-section dielectric cores of width 3.8720 mm on each side, and dielectric beams of 0.925 mm thickness, and using S=89, L=47, P=7, G=4, d=6, D=12, U=2, H=32, where the integer numbers refer to numbers of spatial discretization steps of the simulation model. Unless mentioned otherwise, the spatial discretization step size is Δs=0.185 mm along Z and Δs=0.121 mm along X and Y. The frequency of operation is f=12 GHz. It will be appreciated that all these values are by way of example only. If the material has negligible loss, the design can be scaled for another frequency by simply changing the values of the parameter Δs along Z and along X and Y. The simulation results presented in FIGS. 15-17 represent a significant improvement over the results found in prior art.

FIG. 15 shows the simulated CPSS performance in terms of the magnitudes of the co-polar (thicker lines) and cross-polar (thinner lines) CP scattering, i.e. reflection (R) and transmission (T), coefficients in the XZ plane, plotted on a linear scale, in dependence on the angle of incidence θ, with the second subscript indicating the incident wave polarization and the first subscript indicating the scattered, i.e. transmitted or reflected, wave polarization; so that for example $R_{LL}$ denotes the co-polar reflection coefficient relating the complex amplitude of the reflected LHCP wave to that of the incident LHCP wave, $R_{RR}$ denotes the co-polar reflection coefficient relating the complex amplitude of the reflected RHCP wave to that of the incident RHCP wave, $R_{RL}$ denotes the cross-polar reflection coefficient relating the complex amplitude of the reflected RHCP wave to that of the incident LHCP wave, $R_{LR}$ denotes the cross-polar reflection coefficient relating the complex amplitude of the reflected LHCP wave to that of the incident RHCP wave, and similar designations for the transmission coefficients $T_{LL}$, $T_{RR}$, $T_{RL}$ and $T_{LR}$. '0' and '180' degrees correspond to normal incidence at opposite CPSS faces.

The thick solid curve refers to the co-polar reflection coefficient R_LL. The thin solid curve refers to the cross-polar reflection coefficient R_LR. Similarly, the thick and the thin dot-dashed curves refer to the co-polar and the cross-polar transmission coefficients T_LL and T_LR respectively. The thick and the thin dashed curves refer to the co-polar and the cross-polar reflection coefficients R_RR and R_RL respectively. The thick and the thin dotted curves refer to the co-polar and the cross-polar transmission coefficients T_RR and T_RL respectively. The magnitude of any scattering coefficient must always be equal to or less than 1. Hence, all curves in FIG. 15 should be bound by an ordinate value of 1.

The values of plane wave scattering coefficients may be inaccurate over the angular range of about 45°≤θ≤135° due to limitations of the numerical technique implemented in the software, with the angular range of validity of the simulations results being θ<45° and θ>135°. FIGS. 15-17 show only simulation results over the angular range of validity.

FIG. 16 shows the same 8 dependences as FIG. 15 but plotted on a decibel (dB) scale rather than the linear scale of FIG. 15, wherein the value in dB is computed as $X_{dB}=20*\log_{10}(|X|)$ where |X| refers to the magnitude of the complex amplitude X.

On a linear scale, an ideal LHCPSS would have the magnitude curves for $R_{LL}$ and $T_{RR}$ at ordinate value 1 while having the other magnitude curves $R_{RL}$, $R_{RR}$, $R_{LR}$, $T_{LR}$, $T_{LL}$ and $T_{RL}$ at ordinate value 0, and the AR curves for $R_{LL}$ and $T_{RR}$ at ordinate value 1.

The inward convention for labeling the propagation direction of waves that is used herein is defined with the propagation vector of an incident plane wave pointing inwards, i.e. toward the origin of the coordinate system, and the propagation vector of a scattered plane wave pointing outwards. The incidence direction is defined by the conventional spherical coordinate angles θ and ϕ with the zenith angle θ referenced to the positive Z axis, the azimuthal angle ϕ referenced to the positive X axis and the origin of the spherical coordinate system located at the centre of the CPSS with the Z axis being normal to the faces of the CPSS.

The transmission coefficient is shown here with the conventional transmission line definition whereby the positive direction of the E field vector is that whose tangential (to the interface) component of the E field vector points in the same direction for the incident, reflected and transmitted waves so that the LP reflection coefficients of the parallel and the perpendicular polarizations are identical at normal incidence.

The CPSS performance can be characterized in terms of the axial ratio (AR) of the scattered radiation. The AR is defined herein as the ratio of the minor to the major axes of the polarization ellipse of the scattered wave, hence AR≤1.

The CPSS performance can also be characterized in terms of the following performance parameters that are common in the technical literature: IL, which is the Insertion Loss in dB, Iso, which is the Isolation in dB, TIL, which is the θ angular range over which IL<0.5 dB in degrees, and TIso, which is the θ angular range over which Iso>24 dB in degrees. From FIG. 16, the following exemplary values of these performance parameters may be obtained:

$IL_R=-20*\log_{10}(|R_{LL}|)=0.0014$ dB, which is the CPSS insertion loss in reflection wherein $|R_{LL}|$ refers to the magnitude of the complex amplitude $R_{LL}$.

$IL_T=-20*\log_{10}(|T_{RR}|)=0.0006$ dB, which is the CPSS insertion loss in transmission wherein $|T_{RR}|$ refers to the magnitude of the complex amplitude $T_{RR}$.

$Iso_R=-20*\log_{10}(|R_{RR}|)=50.1$ dB, which is the Isolation in reflection at θ=0 degree, and $Iso_R=49.8$ dB which is the Isolation in reflection at θ=180 degrees wherein $|R_{RR}|$ refers to the magnitude of the complex amplitude $R_{RR}$.

$Iso_T=-20*\log_{10}(|T_{LL}|)=37.1$ dB, which is the Isolation in transmission at θ=0 and 180 degrees wherein $|T_{LL}|$ refers to the magnitude of the complex amplitude $T_{LL}$.

The values for TIL are about 21 degrees for an illumination from above (i.e. the left end of the plot), and about 20 degrees for an illumination from below (i.e. the right end of the plot). In FIG. 16, TIL is shown for the worst case, i.e. TIL is shown at the right end of the figure. The values of TIso are about 10 degrees for both sides, so TIso is arbitrarily shown at the right end of the figure.

FIG. 17 shows the angular dependence of the AR, wherein '$R_L$' and '$R_R$' refer to the AR of the reflect wave when the incident wave is LHCP and RCHP, respectively, and '$T_L$' and '$T_R$' refer to the AR of the transmitted wave when the incident wave is LHCP and RCHP, respectively. In FIG. 17, the values for $R_L$ are 0.14 dB and 0.15 dB at θ=0 and 180 degrees, and the values for are 0.15 dB and 0.14 dB at θ=0 and 180 degrees. The values for TA for −3 dB threshold is about 25 degrees at the left end of the θ angular range, and 15 degrees at the right end. Showing TA for the worst case, TA is shown at the right end of the θ angular range.

Tables 1 to 6 illustrate simulation results for the performance for a LHCPSS formed of a Cartesian array of 30×30 cells, each cell with a free-standing double crankwire with side-to-side EM coupling as illustrated in FIG. 5 and TLs embedded in dielectric cores of bulk permittivity $\in_r$=4 and cross-section 7.0×17.0 mm, using a spatial discretization step size Δs=0.185 mm along X, Y and Z with a frequency of operation f=12 GHz, in terms of figures of merits Q, A, TQ and TA, with 'Q' and 'TQ' indicated as in FIGS. 15 and 16, and 'A' and 'TA' indicated as in FIG. 17. 'Q' refers to the width of an opening O(θ=0.180)) between the T and R curves at normal incidence, corresponding to the difference between the minimum among the $R_{LL}$ and $T_{RR}$ values, and the maximum among the $T_{LL}$, $R_{RR}$, $T_{LR}$, $T_{RL}$, $R_{RL}$ and $R_{RL}$ values, at normal incidence, as indicated by vertical arrows at θ=0 and 180 degrees in FIG. 15; the length of the smallest of these two arrows is taken a 'Q'. 'TQ' refers to the minimum range of the angle of incidence θ over which the opening is larger than or equal to $1/\sqrt{2}$, as indicated by two horizontal arrows extending from θ=0 and 180 degrees in FIG. 15; the length of the smallest of these two arrows is taken as 'TQ'; the symbol 'N/A' is used to indicate that the opening is less than $1/\sqrt{2}$. 'A' refers to the smallest peak value among the AR values for $R_{LL}$ and $T_{RR}$ at normal incidence, while 'TA' refers to the minimum angular range in θ over which the AR values for $R_{LL}$ and $T_{RR}$ are larger than or equal to $1/\sqrt{2}$.

Table 1 shows simulated figures of merit Q, A, TQ and TA for a LHCPSS with S=61, G=2, U=2, d=5, W=5 and different values of L and P.

TABLE 1

| L, P | Q | A | TQ (deg) | TA (deg) |
|---|---|---|---|---|
| 45, 31 | 0.218 | 0.92 | N/A | 22.7 |
| 38, 17 | 0.407 | 0.92 | N/A | 18.3 |
| 36, 13 | 0.538 | 0.91 | N/A | 16.8 |
| 34, 9 | 0.744 | 0.90 | 17 | 14.7 |
| 33, 7 | 0.884 | 0.90 | 16 | 13.6 |
| 32, 5 | 0.922 | 0.89 | 14 | 12.5 |
| 31, 3 | 0.720 | 0.87 | 4 | 11.5 |
| 30, 1 | 0.433 | 0.85 | N/A | 10.4 |

The results in Table 1 show that:

i) the optimum performance is reached in this exemplary case with P = 5, ii) the optimum performance is reached with a value of L = 32 that is substantially different from L = 48 which corresponds to the length of about 3λ/8 that is required for the transverse segments of Pierrot's single crankwire, and iii) the performance varies asymmetrically about the optimum value of P.

As the coupling length P decreases, the amount of side-to-side EM coupling decreases. For P near 0, there is still some amount of EM coupling but the coupling is no longer side-to-side but rather end-to-end between the ends of the two respective transverse segments. When P becomes negative, i.e. when the overlap becomes in fact a gap between the TS ends, there is practically no more EM coupling between the TSs. Tilston's design would correspond to the case where there was little or no EM coupling.

Simulations show that when the TS gap G is increased from G=2 to G=4, an optimum overlap length P must be nearly doubled to obtain about the same amount of EM coupling. This agrees with the capacitance between the two edges of the two coupled transverse segments varying inversely proportional with the gap separation G and directly proportional with the overlap length P. This observation is borne out in Table 2 which presents the values of the figures of merit for the same type of LHCPSS as that of Table 1 when P is varied, with G=2 or 4, S=61, U=2, d=5. In simulations, the value of G was varied by varying the value of W so as to maintain constant the values of S, d and U.

TABLE 2

| G, P, L, W | Q | A | TQ (deg) | TA (deg) |
|---|---|---|---|---|
| 2, 5, 32, 5 | 0.922 | 0.89 | 14 | 12.5 |
| 4, 9, 34, 4 | 0.912 | 0.85 | 15 | 12.7 |
| 4, 11, 35, 4 | 0.894 | 0.86 | 16 | 13.9 |

FIG. 18 illustrates by way of example the dependence of Q on the ratio C=P/G according to the results summarized in Tables 1 and 2. As can be seen from the plot, the exemplary CPSS achieves the best efficiency in separating the CPs of different handedness when C is in the range from about 2 to 4, with Q falling below 0.5 when C is less than approximately 1 or greater than approximately 7.

As stated hereinabove, when the electrical length of the transmission line is a half-wavelength, the value of the characteristic impedance $Z_0$ of the transmission line is not critical. For a bifilar transmission line with circular conductors of diameter d, separated by a centre-to-centre distance D, the value of the characteristic impedance of the transmission line is obtained as:

$$Z_o = \frac{\eta}{\pi}\operatorname{arccosh}\left(\frac{D}{d}\right)$$

where $\eta=\sqrt{\mu/\in}$ is the intrinsic impedance of the propagation medium in which the transmission line is embedded. The results in Tables 1-2 were obtained with d=5 which resulted in D/d=2.12 and arccos h(D/d)=1.384. When the diameter of the cylindrical conductors is decreased from d=5 to d=3, there results D/d=3.536 and arccos h(D/d)=1.935 which represents a 40% change in the value of $Z_0$. Yet, in spite of this large change in the value of $Z_0$, the values of the figures of merit shown in Table 3 change little. Hence, the input impedance of the transverse offset dipoles does not have to be matched to the value of $Z_0$.

TABLE 3

| d | Q | A | TQ (deg) | TA (deg) |
|---|---|---|---|---|
| 5 | 0.922 | 0.89 | 14 | 12.5 |
| 3 | 0.927 | 0.91 | 19 | 16.7 |

The results presented hereinabove demonstrate that the presence of the dielectric core and of a suitable amount of EM coupling improve the performance under both normal and oblique incidences.

Table 4 presents the values of the figures of merit when the value of the period S is varied, with G=2 and P=5. Table 5 presents the values of the figures of merit when the CPSS period S is varied with G=4. The results show that the value of Q degrades as S changes away from an optimum value, with S=61 being nearly optimum for both cases of G=2 and G=4 in the exemplary case considered here. Advantageously, the near-optimum value of S is smaller than a half-wavelength, as required to avoid the formation of the secondary lobes in the radiation pattern of the array, and to avoid the presence of higher-order propagation modes over the array. Tables 4-5 also show that the degradation in the value of Q when S deviates from an optimal value is faster for G=2 than for G=4.

TABLE 4

| P = 5, G = 2, U = 2, d = 5, W = 5 | | | | |
|---|---|---|---|---|
| S, L | Q | A | TQ (deg) | TA (deg) |
| 59, 31 | 0.791 | 0.88 | 7 | 9.4 |
| 61, 32 | 0.922 | 0.89 | 14 | 12.5 |
| 63, 33 | 0.905 | 0.89 | 17 | 15.0 |

TABLE 5

| G = 4, U = 2, d = 5, W = 4 | | | | |
|---|---|---|---|---|
| S, P, L | Q | A | TQ (deg) | TA (deg) |
| 59, 9, 33 | 0.819 | 0.84 | 6 | 10.1 |
| 61, 9, 34 | 0.912 | 0.85 | 15 | 12.7 |
| 63, 9, 35 | 0.864 | 0.85 | 15 | 15.0 |
| 61, 11, 35 | 0.894 | 0.86 | 16 | 13.9 |
| 55, 11, 32 | 0.651 | 0.86 | N/A | 2.6 |

Table 6 presents the values of the figures of merit for different values of the azimuthal angle $\phi$ of incidence so as to assess the performance in different azimuthal directions of incidence. The value of $\phi=0$ corresponds to the positive half of the XZ plane, i.e. the incident plane wave is incident from the positive half of the XZ plane in FIG. 5. The results of Table 6 show that the performance varies slightly with the azimuthal direction of incidence. In fact, due to the trace pattern on one face of the CPSS being the 90 degree rotation of that on the other face, the T, R and AR curves for $\phi=(-45+\Delta\phi)$ degrees in one hemisphere are those for $\phi=(-45-\Delta\phi)$ degrees in the other hemisphere, mirrored about $\theta=90$ degrees. For example, with $\Delta\phi=15$ degrees, the curves for $\phi=-30$ degrees in one hemisphere are the mirrored curves for $\phi=-60$ degrees in the other hemisphere. Consequently, the curves for $\phi=-45$ degrees are symmetrical about $\theta=90$ degrees. The results of Table 6 cover only one quadrant of the azimuthal range. The results in the three other quadrants can be obtained from those shown in Table 6 by using the fact that the geometry has a 2-fold rotational symmetry in azimuth and that the trace pattern on one face is the 90 degree rotation of that on the other face.

TABLE 6

| $\phi$ (deg) | Q | A | TQ (deg) | TA (deg) |
|---|---|---|---|---|
| 0 | 0.927 | 0.91 | 19 | 16.7 |
| −15 | 0.927 | 0.91 | 14 | 15.7 |
| −30 | 0.927 | 0.91 | 12 | 15.0 |
| −45 | 0.927 | 0.91 | 12 | 14.8 |
| −60 | 0.927 | 0.91 | 12 | 15.2 |
| −75 | 0.927 | 0.91 | 15 | 16.6 |
| −90 | 0.927 | 0.91 | 20 | 20.1 |

Thus, the simulation results confirm that the CPSS of the present invention, with the endwise coupling of the constituent crankwires or dipoles, provides a superior performance as compared to non-coupled designs in terms of its high efficiency, under both normal and oblique incidences, in discriminating between two senses of the CP polarization of an incident EM wave, i.e. predominantly reflecting radiation of one CP sense while predominantly transmitting CP polarization of the other CP sense.

Figure 19:
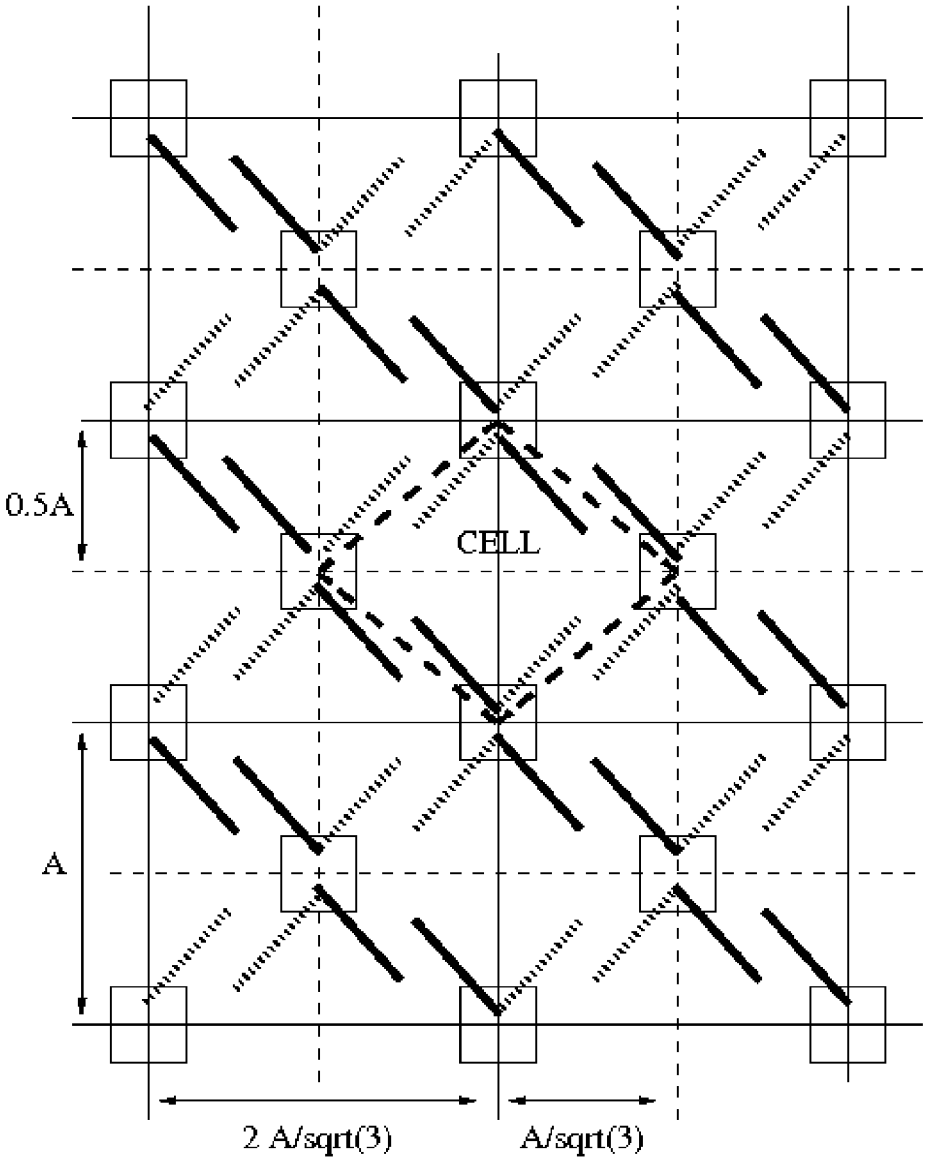
FIG. 19 is a schematic top view of a CPSS array with triangular tiling configuration.

The above-described exemplary embodiments are intended to be illustrative in all respects, rather than restrictive, of the present invention. Thus the present invention is capable of many variations in detailed implementation that can be derived from the description contained herein by a person skilled in the art. For example, the double crankwires of the present invention may be arranged not only in a Cartesian array as described hereinabove, but also in other types of array, such as for example a triangular 2D array. Such an array may be viewed as comprised of cells that are disposed in a triangular tiling configuration as obtained with interlacing two Cartesian arrays of suitable periods and offsets relative to one another, as depicted in FIG. 19, wherein the vertical period is A, the horizontal period is $2A/\sqrt{3}$, the vertical offset is 0.5 A and the horizontal offset is $A/\sqrt{3}$, and wherein the two interlaced arrays are indicated by solid and dashed lines, respectively, with longitudinal TLs shown by squares. The advantage of using a triangular mesh instead of a Cartesian mesh is that the triangular mesh provides a denser and a more rotationally uniform arrangement of the array elements. As another example of possible variations in detailed implementation, the ends of the transverse segments can be shaped not only as square ends as described hereinabove, but also as other shapes, such as for example rounded or pointed ends.

Of course numerous other embodiments may be envisioned without departing from the scope of the invention. All such variations and modifications are considered to be within the scope and spirit of the present invention as defined by the following claims.

I claim:

1. A circular polarization selective surface (CPSS) comprising:

a plurality of cells, each cell comprising two crankwires of the same handedness, each crankwire comprising a longitudinal segment electrically connecting two transverse segments, each of the segments being electrically conductive;

wherein each of the crankwires of each cell being positioned adjacent the periphery of the cell so that the longitudinal segment of a first crankwire in a first cell is positioned adjacent to, and transversely aligned with, the longitudinal segment of a second crankwire in a second cell adjacent the first cell for coupling thereto so as to form a transmission line that is longitudinally oriented;

wherein one transverse segment of the first crankwire is disposed for endwise coupling with a nearest transverse segment of a crankwire in a third cell adjacent the first cell, so as to define a first pair of end-coupled transverse segments;

wherein the other transverse segment of the first crankwire is disposed for endwise coupling with a nearest transverse segment of a crankwire in a fourth cell adjacent the first cell, so as to define a second pair of end-coupled transverse segments; and, wherein the transverse segments in at least one of the first and second pairs comprise end portions facing each other along a coupling length P with a gap G therebetween, wherein G is the width of the gap separating the end portions, and wherein said gap extends along said end portions over the coupling length P that is at least half of the width G of the gap.

2. The CPSS according to claim 1, wherein the cells are disposed generally side-by-side so that the transverse segments of the crankwires comprised in the plurality of cells define first and second CPSS faces, and wherein the two crankwires in each cell are positioned with their respective transverse segments spaced apart and oriented about a longitudinal axis of the cell so as to provide the cell with a 2-fold rotational symmetry, wherein the longitudinal axis is generally perpendicular to the first and second CPSS faces.

3. The CPSS according to claim 2, wherein the two transverse segments of each crankwire are spaced apart in the longitudinal direction by an electrical distance of 90°, the longitudinal transmission line has an electrical length of 180°, and the transverse segments have an electrical length of 90° each.

4. The CPSS according to claim 2, wherein the plurality of cells form a 2D periodic array.

5. The CPSS according to claim 2, wherein each cell has a substantially square shape.

6. The CPSS according to claim 2, wherein the plurality of cells includes one or more inner cells, wherein each longitudinal segment of each crankwire in the one or more inner cells forms a longitudinal transmission line with a longitudinal segment of a crankwire in an adjacent cell, so as to form a plurality of longitudinal transmission lines having an electrical length of a half-wavelength each, and wherein each of the transverse segments in the one or more inner cells is endwise coupled to a nearest transverse segment of a crankwire in an adjacent cell, so as to form a plurality of end-coupled pairs of transverse segments.

7. The CPSS according to claim 2, wherein the plurality of cells forms a 2D array having a period that varies across the array.

8. The CPSS according to claim 6, wherein each of the transverse segments of the two crankwires in each inner cell has an end-coupling portion directly facing an end-coupling portion of the nearest transverse segment of the crankwire in the adjacent cell along the coupling length P with the gap G therebetween.

9. The CPSS according to claim 8 wherein the ratio of P to G is at least 0.5.

10. The CPSS according to claim 8 wherein the transverse segments in each end-coupled pair extend alongside each other over the coupling length P with the gap G therebetween.

11. The CPSS according to claim 8 wherein the end-coupling portions of the transverse segments are bent relative to the rest of the respective transverse segments.

12. The CPSS according to claim 8 wherein the end-coupling portions of the transverse segments are flared to provide enhanced end-to-end coupling between the transverse segments in each end-coupled pair of the transverse segments.

13. The CPSS according to claim 6 further comprising a substrate made of a dielectric material for supporting the crankwires, wherein the two transverse segments of each crankwire are formed of conducting strips disposed on opposite faces of the substrate, and wherein the longitudinal segments are embedded in the dielectric material of the substrate, and wherein the substrate is shaped so that, for a given frequency of an incident electromagnetic wave, an electrical thickness of the substrate in the direction along the longitudinal segments of the crankwires is substantially 90 degrees, an electrical length of the longitudinal transmission lines is substantially 180 degrees, and an electrical length of the transverse segments is substantially 90 degrees.

14. The CPSS according to claim 13 wherein the substrate has an opening or thinning in regions away from the longitudinal transmission lines so as to make the electrical length of the longitudinal transmission lines twice the electrical thickness of the substrate.

15. The CPSS according to claim 14 wherein:

the substrate is formed of two sets of parallel beams, wherein:

the beams of one set is disposed orthogonally over the beams of the other set orthogonally thereto to form a rectangular grid, the longitudinal segments of the crankwires are embedded at beam intersections, and the transverse segments of each crankwire are disposed upon the outer faces of the beams of the first and second sets extending from the beam intersection.

16. The CPSS according to claim 15 wherein the transverse segments of each end-coupled pair of transverse segments are disposed upon the same side of the same beam.

17. The CPSS according to claim 15 wherein the beams are connected at beam intersections by dielectric columns so as to provide the substrate with corrugated faces, each longitudinal dielectric column comprising at least a portion of one of the longitudinal transmission lines.

18. The CPSS according to claim 13 wherein the substrate has corrugated faces, each face comprising a set of parallel ridges for supporting the transverse segments of the crankwires, wherein the ridges at one face is generally orthogonal to the ridges at the other face of the substrate.

19. The CPSS according to claim 13 wherein the longitudinal segments comprise metalized via-holes extending through the substrate.

20. The CPSS according to claim 1, further comprising a substrate made of a dielectric material for supporting the crankwires, wherein the transverse segments of each two adjacent crankwires having coupled longitudinal segments form two dipoles oriented orthogonally to each other on opposite faces of the substrate, so as to form chains of endwise-coupled dipoles, wherein each dipole is comprised of two dipole arms formed by two transverse segments.

21. The CPSS according to claim 20, wherein the two dipole arms of each dipole are laterally offset relative to one another on the same face of the substrate.

* * * * *